US006582896B1

(12) United States Patent
Ito et al.

(10) Patent No.: US 6,582,896 B1
(45) Date of Patent: Jun. 24, 2003

(54) PHOTOTHERMOGRAPHIC MATERIAL

(75) Inventors: Tadashi Ito, Minami-ashigara (JP); Yasuo Mukunoki, Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/632,000

(22) Filed: Aug. 3, 2000

(30) Foreign Application Priority Data

Aug. 3, 1999 (JP) ..... 11-220378

(51) Int. Cl.[7] ..... G03C 1/498

(52) U.S. Cl. ..... 430/619; 430/598; 430/620; 430/631; 430/634; 430/635

(58) Field of Search ..... 430/619, 631, 430/617, 531, 634, 635, 598, 620

(56) References Cited

U.S. PATENT DOCUMENTS 5,330,885 A * 7/1994 Takamuki et al. ..... 430/523
5,545,515 A * 8/1996 Murray et al. ..... 430/617
5,705,324 A * 1/1998 Murray ..... 430/350
6,165,707 A * 12/2000 Hirano et al. ..... 430/619
6,232,059 B1 * 5/2001 Yamda et al. ..... 430/619

FOREIGN PATENT DOCUMENTS

EP 02921433 * 6/1999 ..... G03C/1/498

* cited by examiner

*Primary Examiner*—Thorl Chea
(74) *Attorney, Agent, or Firm*—Birch, Stewart, Kolasch & Birch, LLP

(57) ABSTRACT

A photothermographic material includes on a support a non-photosensitive sliver salt, a photosensitive sliver halide, a nucleation agent, and a binder, and a layer containing specific compounds is formed on an outer side of the image forming layer. Thus, there are obtained such images optimal for photomechanical processes as having a high Dmax (maximum density), a low fog, a good coated surface condition, and less surface defects such as repellency, coating lines or the like.

23 Claims, 1 Drawing Sheet

PHOTOTHERMOGRAPHIC MATERIAL

FIELD OF THE INVENTION

This invention relates to a photothermographic material and, more particularly, to a photothermographic material for scanners, image setters or the like suitable for photomechanical processes. More specifically, this invention relates to a photothermographic material that can obtain such images optimal for photomechanical processes as having a high Dmax (maximum density), a low fog, a good coated surface condition, and less surface defects such as repellency, coating lines or the like.

RELATED ARTS

A large number of photosensitive materials having a photosensitive layer on a support for forming images upon imagewise exposure have been known. Among them, as a system for rendering image forming means simplified, a technology for forming images by heat development is utilized.

In recent years, reduction of the amount of waste processing solutions is strongly demanded in the field of photomechanical processes from the standpoint of environmental preservation and space savings. To cope with this, techniques are needed in relation to heat photosensitive developable materials for use in photomechanical processes, which can be effectively exposed by a laser scanner or laser image setter and can form clear black images having high resolution and sharpness. Such photothermographic materials can provide a heat development processing system, without use of solution-type processing chemicals, simpler and free from incurring environmental destruction.

Methods for forming an image by heat development are described, for example, in U.S. Pat. Nos. 3,152,904 and 3,457,075 and D. Morgan and B. Shely, Imaging Processes and Materials, "Thermally Processed Silver Systems" A, 8th ed., page 2, compiled by Sturge, V. Walworth and A. Shepp, Neblette (1969). The photosensitive material described in the above contains a light-insensitive silver source (e.g., organic silver salt) capable of reduction, a photocatalyst (e.g., silver halide) in a catalytic activity amount, and a reducing agent for silver, which are usually dispersed in an organic binder matrix. This photosensitive material is stable at room temperature, but, when it is heated at a high temperature (e.g., 80° C. or higher) after the exposure, silver is produced through an oxidation-reduction reaction between the silver source (which functions as an oxidizing agent) capable of reduction and the reducing agent. The oxidation-reduction reaction is accelerated by the catalytic action of a latent image generated upon exposure. The silver produced by the reaction of the silver salt capable of reduction in the exposure region provides a black image and this presents a contrast to the non-exposure region. Thus, an image is formed.

In most of conventional photothermographic materials, the photosensitive layer is formed by coating a coating liquid having a solvent as an organic solvent such as toluene, methyl ethyl ketone (MEK), methanol, and the like. Use of such organic solvents as a solvent not only adversely affects human bodies during manufacturing processes but also is disadvantageous in term of costs due to recycling the solvents and others.

To cope with this, a method has been considered in which a photosensitive layer is formed using a coating liquid of a water solvent not having the above problem. For example, Japanese Unexamined Patent Publication (KOKAI) Showa (hereinafter referred to as "JP-A-") Nos. 49-52, 626 and 53-116,144, and the like set forth an example that gelatin is used as a binder. Also, JP-A-50-151,138 sets forth an example that a polyvinyl alcohol is used as a binder. In JP-A-60-28,737, an example that a gelatin and a polyvinyl alcohol are used together is described. In addition, as another example other than the above examples, JP-A-58-28,737 sets forth an example of a photosensitive layer that a water-soluble polyvinyl acetal is used as a binder.

Such a binder surely allows to form the photosensitive layer in use of a coating liquid with a water solvent, thereby making such use advantageous in terms of environments and costs.

However, if the polymer such as gelatin, polyvinyl alcohol, water-soluble polyvinyl acetal, and so on is used as the binder, not only that a silver tone at the developed portion is rendered brown or yellow which is so deviated from black, originally favored color, or products having considerably diminished values are only obtained such that the blackened concentration at a light exposed section is low while the concentration at an unexposed portion is high, but also that the binder has a bad solubility with an organic silver salt, thereby rendering coatings unavailable with a surface having a practically durable quality.

European Patent No. 762,196, and JP-A-9-90,550 disclose that photosensitive silver halide particles used for the photothermographic materials contain VII-group or VIII-group metal ions or metal complex ions and that high contrast photographic characteristics can be obtained by containing hydrazine derivatives in the photosensitive materials. However, if the binder used in the coating liquid of the above water solvent and a nucleation agent such as hydrazine are concurrently used, a high contrast image can be obtained, but at the same time there raise problems such that fog may likely occur.

On the other hand, it is possible that lowering pH of a surface of an outmost layer on an image forming layer side reduces the fog to some extent, but there occurs surface defects such as repellency or coating lines, and these defects avoid applications that require a large screen such as, especially, photomechanical process from being practically used.

Accordingly, an object of the present invention is to solve these problems of conventional art.

That is, an object of the present invention is to provide, advantageously in terms of environments and costs, a photothermographic material suitable, especially for such as scanners, image setters or the like, for photomechanical processes, the heat photosensitive material being capable of obtaining such images optimal for photomechanical processes as having a high Dmax (maximum density), a low fog, a good coated surface condition, and less surface defects such as repellency, coating lines or the like.

SUMMARY OF THE INVENTION

As a result of diligent study for accomplishing these objects, the present inventors found that an excellent photothermographic material achieving desired advantages can be provided by forming a layer containing specific compounds on an outer side of the image forming layer, and the present invention has been accomplished.

That is, the present invention is to provide a photothermographic material having on a support a non-photosensitive sliver salt, a photosensitive sliver halide, a nucleation agent, and a binder, comprising, on an outer side of the image forming layer, a layer including:

one or more organic acid compounds represented by following Formula (1),

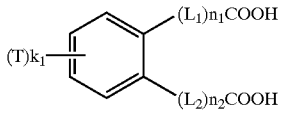

(where T represents a univalent substituent and $k_1$ represents an integer of from 0 to 4; in the case of $k_1>2$, each of plurality of T may be the same or different one another and may be combined to form a ring; $L_1$ and $L_2$ each represents a bivalent linking group; $n_1$ and $n_2$ each independently represents an integer of from 0 to 30), and one or more compounds represented by following Formula (2), Formula (2)

$$R-(A)_n-Y$$

(where R represents an alkyl group, an alkenyl group or an aryl group which may be substituted or unsubstituted and have 6 to 30 carbon atoms; A represents a bivalent linking group; n represents an integer of from 0 to 50; Y represents —$SO_3M$ or —$OSO_3M$; M represents a hydrogen atom, an alkali metal atom, an alkaline-earth metal atom, an ammonium group or a lower alkylamine).

In the photothermographic material according to the present invention, the image forming layer preferably contains 50% by weight or higher of a polymer latex, as a binder, having a glass transition temperature of −30° C. to 40° C. with respect to the whole binder.

Further, in the photothermographic material, the nucleation agent is at least one compound selected from a group consisting of:

a substituted alkene derivative represented by following Formula (3),

Formula (3)

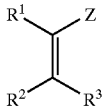

(where $R^1$, $R^2$ and $R^3$ each independently represents a hydrogen atom or a substituent, Z represents an electron withdrawing group or a silyl group, and $R^1$ and Z, $R^2$ and $R^3$, $R^1$ and $R^2$, and/or $R^3$ and Z may be combined with each other to form a ring), a substituted isoxazole derivative represented by following Formula (4), Formula (4)

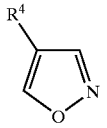

(where $R^4$ represents a substituent), and an acetal compound represented by following Formula (5), Formula (5)

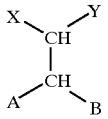

(where X and Y each independently represents a hydrogen atom or a substituent, A and B each independently represents an alkoxyl group, an alkylthio group, an alkylamino group, an aryloxy group, an arylthio group, an anilino group, a heterocyclic oxy group, a heterocyclic thio group or a heterocyclic amino group, and each of X and Y, as well as, A and B may be combined with each other to form a ring structure).

In addition, pH of a surface of an outmost layer on the image forming layer side of the photothermographic material according to the present invention is preferably 6 or less.

DETAILED DESCRIPTION OF THE INVENTION

Figure 1:
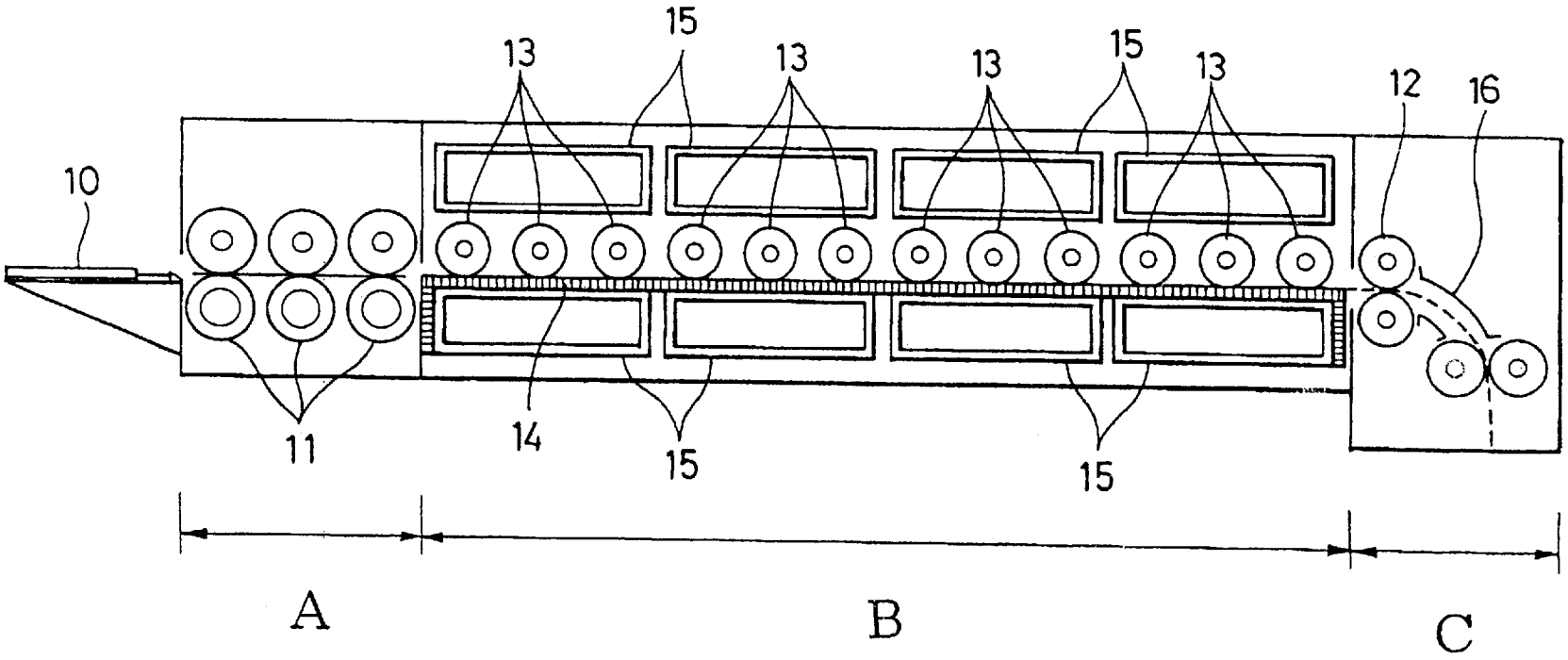
FIG. 1 is a side view showing a structural example of a heat developing machine.

Hereinafter, the photothermographic material according to the present invention will be described in detail.

The photothermographic material according to the present invention has, on a support, a non-photosensitive sliver salt, a photosensitive sliver halide, a nucleation agent, and a binder.

The photothermographic material according to the present invention has a shape of sheet, roll or the like, and the support may be transparent or not transparent, but the preferable support is transparent. Specific examples of the support include resin materials, such as polyester film, undercoating polyester film, poly (polyethylene terephthalate) film, polyethylene naphthalate film, cellulose nitrate film, cellulose ester film, poly (vinylacetal) film, polycarbonate film or the like, glass, paper, metal and so on. There is raised, as a typical support, a paper support coated by a polymer, and the polymer is a flexible base material, particularly, such as partially acetified and/or baryta α-olefin polymer, particularly, α-olefin polymer having 2 to 10 carbon atoms such as polyethylene, polypropylene, ethylene-butene copolymer, and the like. Among these, biaxially stretched polyethylene terephthalate to about 75 to 200 μm is preferred.

When a plastic film is subjected to a treatment under 80° C. or higher in the heat developing machine, the size of the film is generally stretched or contracted. In the case of that the material after the treatment is used for application of a printing plate process, this stretching and contraction of the size leads to serious problems in performing a precision multicolor printing. Accordingly, it is preferable in the present invention to use a film, having less change in size, being designed to alleviate internal distortions remaining in the film at the time of biaxial stretching and to eliminate heat-contraction distortions produced in heat developing. For example, preferably used is polyethylene terephthalate or the like subjected to heat treatment in a range of 100° C. to 210° C. prior to the application of photographic emulsion for heat developing. Also, the material having a high glass transition temperature is preferably used, such as polyether ethyl ketone, polystyrene, polysulfone, polyether sulfone, polyarylate, polycarbonate or the like.

The photothermographic material according to the present invention preferably has, on at least one side of the support, an image forming layer (or a photosensitive layer) containing an organic silver salt as a non-photosensitive sliver salt, a photosensitive sliver halide, a nucleation agent and a binder.

An organic silver salt is used as the non-photosensitive silver salt. The organic silver salt usable in the present invention is an arbitrary organic substance containing a source capable of reducing a silver ion, and is relatively stable against light but forms a silver image when it is heated at 80° C. or higher in the presence of an exposed photocatalyst (e.g., a latent image of photosensitive silver halide) and a reducing agent. Specifically, a silver salt of an organic salt, particularly, a complex of an organic silver salt, of which ligand has a complex stability constant of from 4.0 to 10.0, is raised. The preferred organic silver salt includes a silver salt of an organic compound having a carboxyl group. Examples thereof include an aliphatic carboxylic acid silver salt and an aromatic carboxylic acid silver salt. Among these above, the aliphatic carboxylic acid silver is preferred, and a silver salt of a long chained aliphatic carboxylic acid (having from 10 to 30, preferably from 15 to 28 carbon atoms) is further preferred. The examples include silver behenate, silver arachidinate, silver stearate, silver oleate, silver laurate, silver caproate, silver myristate, silver palmitate, silver maleate, silver fumarate, silver tartrate, silver linoleate, silverbutyrate, silver camphorate and a mixture thereof. Preferably, a silver providing substance may constitute approximately 5 to 70% by weight with respect to the image forming layer.

In this invention, it is preferable to use, among the organic acid silvers or mixtures of the organic acid silvers exemplified above, the organic acid silver having a silver behenate containing rate of 75 mol % or higher, more preferably 85 mol % or higher. The silver behenate containing rate indicates a mole percentage of the silver behenate to the organic acid silver to be used. As organic acid sliver other than the silver behenate contained in the organic acid silver used in this invention, the above exemplified materials can be used preferably.

The organic acid slivers preferably used in this invention are prepared by reaction of an alkali metal salt (Na (sodium) salt, K (potassium) salt, Li (lithium) salt, and the like can exemplified) solution or suspension of the organic acid silver as described above with silver nitrate. The organic acidalkalimetal salt of the present invention can be obtained from alkali treatments of the above organic acid. The organic acid silver of the invention can be done in either a rotary or continuous manner in an arbitrary suitable container. Stirring in the reaction container can be done by any stirring method depending on the characteristics demanded from the particles. As a preparing method for organic acid silver, any of methods can be preferably used in which a silver nitrate solution is slowly or rapidly added in a reaction container containing an organic acid alkali metal salt solution or suspension, in which a previously prepared organic acid alkali metal salt solution or suspension is slowly or rapidly added in a reaction container containing a silver nitrate solution, and in which a previously prepared silver nitrate solution and an organic acid alkali metal salt solution or suspension are added at the same time in a reaction container.

The silver nitrate solution and the organic acid alkali metal salt solution or suspension can be used with any concentration to control the particle size of the prepared organic acid silver, and can be added with any addition rate. As a method for adding the silver nitrate solution and the organic acid alkali metal salt solution or suspension, a method for adding at a constant addition rate, a method for acceleratingly or deceleratingly adding according to an arbitrary time function can be used. The solution and the like can be added to the reaction liquid at the liquid surface or in the liquid. In the case of the method in which the previously prepared silver nitrate solution and the organic acid alkali metal salt solution or suspension are added at the same time in a reaction container, though any of the silver nitrate solution and the organic acid alkali metal salt solution or suspension can be added first, it is preferable to add the silver nitrate solution first. As a preceding degree, an amount of 0 to 50 vol % of the total addition amount is used preferably, and more preferably, it is 0 to 25%vol. A method in which addition is made while the pH and the silver potential of a reaction liquid is controlled during reaction as described in JP-A-9-127,643 is preferably used.

The silver nitrate solution and the organic acid alkali metal salt solution or suspension to be added can control the pH according to the characteristics demanded from the particles. To adjust the pH, an arbitrary acid or alkali can be added. According to the characteristics demanded from the particles, for example, for controlling the particle size of the prepared organic acid silver, the temperature in the reaction container can be set arbitrarily, but also the silver nitrate solution and the organic acid alkali metal salt solution or suspension can be adjusted at an arbitrary temperature. To make sure the fluidity of the organic acid alkali metal salt solution or suspension, it is preferable to keep at 50° C. or higher with heating.

The organic acid silver used in this invention is preferably prepared under existence of a tertiary alcohol. As a tertiary alcohol, it is preferable to use an alcohol having 15 or less, more preferably 10 or less carbon atoms in total. As an example of a preferable tertiary alcohol, tert-butanol and the like are exemplified, but this invention is not limited to those.

Although the tertiary alcohol used in this invention can be added any time during the preparation of the organic acid silver, it is preferable to solve and use the organic acid alkali metal salt upon addition of the alcohol during the preparation of the organic acid alkali metal salt. The use amount of the tertiary alcohol of the invention can be any amount in range of 0.01 to 10 by weight ratio to water as a solvent during the preparation of the organic acid silver, but the range of 0.03 to 1 is preferable.

As a shape of the non-photosensitive silver salt usable in this invention, there is no particular limited to it, but a needle crystal having the minor axis and the major axis is preferred. In this invention, it is preferable that the minor axis is of 0.01 $\mu$m or more and 0.20 $\mu$m or less while the major axis is of 0.10 $\mu$m or more and 5.0 $\mu$m or less, and more preferably, it is that the minor axis is of 0.01 $\mu$m or more and 0.15 $\mu$m or less while the major axis is of 0.10 $\mu$m or more and 4.0 $\mu$m or less. As a measuring method of shapes of the non-photosensitive silver salt, it can be sought by an image made with a transmission type electron microscope of a dispersion of non-photosensitive silver salt.

As a method for measuring a particle size (volume weighted mean diameter) of the solid fine particle dispersion of non-photosensitive silver salt according to the present invention, a laser beam is radiated to the solid fine particle dispersion dispersed in the liquid, and it can be sought from obtained particle sizes (volume weighted mean diameter) through a self-correlation function with respect to time change of fluctuation of the scattered light of the laser beam. The solid fine particle dispersion has a mean particle size of preferably from 0.05 μm or higher to 10.0 μm or less, more preferably from 0.1 μm or higher to 5.0 μm or less, further preferably from 0.1 μm or higher to 2.0 or less.

The size profile of the particles of the non-photosensitive silver salt is preferably a single dispersion. The single dispersion is defined that the percentage of the standard divinations of the lengths of the minor and major axes divided by the minor and major axes, respectively, is preferably, 80% or less, more preferably, 50% or less, and further preferably, 30% or less. As another method for measuring the single dispersion, there is a method for seeking the standard deviation of the volume weighted mean diameter of the non-photosensitive silver salt, and the percentage (deviation coefficient) of a value divided by the volume weighted mean diameter is preferably, 80% or less, more preferably, 50% or less, and further preferably, 30% or less. The volume weighted mean diameter is measured by the above methods.

The non-photosensitive silver salt usable in this invention is preferably subject to desalting. There is no particular limitation to methods for desalting, and known methods can be used. It is preferable to use known filtering methods such as centrifugal filtering, absorbing filtering, ultrafiltration, frock forming washing by cohesion method, and so on.

In this invention, for obtaining a solid dispersion of non-photosensitive silver salt having a smaller particle size with high S/N ratio and without cohesion, a dispersion method is preferably used in which a pressure is decreased after a water dispersion liquid including an photosensitive silver salt serving as image forming media and substantially excluding photosensitive silver salt is converted into a high speed flow.

A photosensitive image forming medium coating liquid is manufactured in mixing the photosensitive silver salt solution after such a process. If a photothermographic material is produced using such a coating liquid, a photothermographic material can be obtained with low haze, low fog and high sensitivity. To the contrary, if the flow is converted to high pressure, high speed flow, and if the photosensitive silver coexists during the dispersion, the fog increases and the sensitivity is lowered so much. If an organic solvent, instead of water, is used for a dispersing medium, the haze becomes so high, and the fog increases, while the sensitivity is likely lowered. On the other hand, if a conversion method in which a part of the non-photosensitive silver salt in the dispersing liquid is converted into a photosensitive silver salt is used instead of a method of mixing the photosensitive silver salt solution, the sensitivity is reduced.

The water dispersing liquid dispersed upon conversion to high pressure and high speed flow substantially excludes a photosensitive sliver salt, and the moisture amount is 0.1 mol % or less with respect to the non-photosensitive silver salt, and the photosensitive silver salt is not positively added.

In this invention, a solid dispersion apparatus and its technology used for implementing the above dispersing methods are described in detail in, e.g., "Bunsankei Rheology to Bunsankagijyutu (Disperse System Rheology and Dispersing Technology)", Toshio Kajiuchi, Hiroki Usui, 1991 Shinzannsya Shuppan (K.K.) p357 to p403, and "Kagaku Kogyou no Sinpo, Dai 24 shyu (Progress of Chemical Engineering, Vol.24), Shyadan Houj inn, Kagakukougyou-kaiTokai shibu, 1990, Maki Shoten, p184 to p185. The dispersing method in this invention is a method in which, after a water dispersion material at least including a non-photosensitive silver salt is sent in a pipe upon pressurized by means of, e.g., a high pressure pump, the material is made to pass through fine slits formed in the pipe, and subsequently the dispersion liquid is rapidly subject to a reduced pressure thereby forming fine dispersions.

With respect to a high pressure homogenizer relating to this invention, it is generally thought that dispersion to fine particles occurs by, e.g., (a) "shearing force" occurring at a time when the dispersoid passes through narrow intervals with high pressure and high speed, and (b) "cavitation force" occurring when the dispersoid is released from the high pressure to the normal pressure. A Gorlin homogenizer can be exemplified as a dispersing apparatus of this type, and in this apparatus, a liquid to be dispersed under a high pressure is converted at narrow channels on a cylindrical surface to a high speed fluid, and collides to surrounding walls with that acceleration, thereby forming emulsion and dispersion by the impacting force. The pressure used is generally in a range of 100 to 600 kg/cm$^2$, and the fluid rate is in a range of several meters to 30 meters per second. To increase the dispersing effect, some are devised to have the high speed portion in a serriform to increase the number of collisions. Meanwhile, recently developed apparatuses are capable of dispersing with further higher pressure and higher flow velocity, and as a representative example, such as Microfluidizer (Microfluidics International Corporation), Nanomizer (TokusyuO Kika Kougyou (K.K.) can be exemplified.

As a dispersing apparatus suitable for this invention, Microfluidizer (Microfluidics International Corporation made), M-110S-EH (G10Z with interaction chamber), M-110Y (H10Z with interaction chamber), M-140K (G10Z with interaction chamber), HC-5000 (L30Z or H230Z with interaction chamber), HC-8000 (E230Z or L30Z with interaction chamber), and the like are exemplified.

A most suitable non-photosensitive silver salt dispersion for this invention can be obtained, using those apparatuses, by creating rapid reduction of pressure in the dispersion liquid by a method such that the pressure in the pipe is rapidly backed to the atmospheric pressure after applying a desired pressure to a water dispersion liquid including at least a photosensitive silver salt by passing the liquid through fine slits formed in the pipe after the liquid is sent to the pipe with pressure from a high pressure pump or the like.

Before the dispersion manipulation, it is preferable to disperse the raw material liquid previously. As a means for pre-dispersion, known dispersing means (such as a high speed mixer, homogenizer, high impact mill, banbury mixer, homo mixer, kneeder, bowl mill, vibration bowl mill, planet bowl mill, at writer, sand mill, beads mill, colloid mill, jet mill, roller mill, tron mill, high speed stone mill) can be used. The liquid can be made with fine particles, in a way other than subjecting to the mechanical dispersion, by changing the pH under existence of dispersion promoters after rough dispersion is made in the solvent by a pH control. As a solvent for the rough dispersion, an organic solvent can be used, and normally, the organic solvent is removed after making the fluid with fine particles.

In the dispersion of the non-photosensitive silver salt in the invention, the dispersion can be made with desired particle sizes by adjustments of the fluid speed, the differential pressures during pressure reduction, and the number of processings. From a standpoint to the photographic characteristics and the particle sizes, a preferable fluid speed is of 200 m/sec to 600 m/sec, and the differential pressure during the reduction of the pressure is preferably in a range of 900 to 3,000 kg/cm$^2$. More preferably, the fluid speed is of 300 m/sec to 600 m/sec, and the differential pressure during the reduction of the pressure is preferably in a range of 1,500 to 3,000 kg/cm$^2$. The processing number of dispersions can be selected according the necessity, and in a normal case, the processing number of one to ten times is selected, and from a standpoint of productivity, the processing number of one to three times is selected. Making the water dispersion liquid at a high temperature under a high pressure is not favorable in terms of dispersion property and photographic characteristics, and if the temperature is high as to exceed 90° C., the particle size may be larger, and fog may increase. Accordingly, in this invention, a cooling process may be contained in either or both of a process before conversion to the high speed flow and a process after the pressure is reduce, and it is preferable to keep the temperature of such a water dispersion in a range of 5 to 90° C. by such a cooling process, more preferably, in range of 5 to 80° C., and further 5 to 65° C. Furthermore, it is effective to set the cooling process as described above for high pressure dispersion in a range of 1500 to 3000 kg/cm$^2$. The cooling apparatus can be selected from a double pipe, one using a static mixer for a double pipe, a multiple pipe type heat converter, a jig-sag pipe type heat converter, and the like. To increase the efficiency of the heat conversion, diameter, thickness, and material of the pipe are selected to be suitable in consideration of the used pressure. The coolant used in the cooling apparatus can be, in consideration of the heat conversion amount, a well water of 20° C. or a cool water of 5 to 10° C. processed in a refrigerator, or a coolant of ethylene glycol, water and the like of −30° C. when necessary.

In a dispersion manipulation of the invention, it is preferable to disperse the non-photosensitive silver salt under existence of a dispersant (dispersion promoter) soluble in an aqueous solvent. As a dispersion promoter, for example, synthetic anion polymers such as polyacrylic acid, acrylic acid copolymer, maleic acid copolymer, maleic acid monoester copolymer, and acryromethyl propanesulfonic acid copolymer, semi-synthetic anion polymers such as carboxylmethyl starch, and carboxylmethyl cellulose, anionic polymers such as alginic acid, and pectic acid, a compound as set forth in JP-A-7-350,753, known polymers such as anionic, nonionic, or cationic surfactants, andpolyvinylalcohol, polyvinylpyrrolidone, carboxymethylcellulose, hydroxymethylcellulose, and hydroxypropylmethylcellulose, and a polymer compound existing naturally such as gelatin or the like can be used, and furthermore, polyvinylalcohol groups, and water-soluble cellulose derivatives can be used more preferably.

The dispersion promoter is made ordinarily by being mixed with powders of the non-photographic silver salt or a wet cake state non-photographic silver salt to be sent to a dispersing machine as a slurry, but can be mixed with the powers of the non-photographic silver salt or a wet cake state non-photographic silver salt upon processing of a thermal treatment or solvent treatment where mixed with the non-photosensitive silver salt in advance. It can be subject to a pH control with a proper pH adjusting agent before or after or during dispersion.

In addition to the mechanical dispersion, the dispersion promoter can be dispersed roughly upon the pH control, and then, fine particles can be formed upon changing the pH under existence of the dispersion promoter. At that time, as a solvent used for the rough dispersion, an organic solvent can be used, and ordinarily, such an organic solvent is removed after making fine particles.

The prepared dispersions may be preserved while being stirred to suppress precipitation of fine particles during preservation or preserved at a high viscosity state (for example, gelatin is used in a jelly state) by means of hydrophilic colloids. An antiseptics may be added to prevent bacteria or the like from prospering.

The solid dispersion of the non-photosensitive silver salt used for preparing the image forming layer includes at least the non-photosensitive silver salt and water. There is no particular limitation to the rate of the non-photosensitive silver salt and the water, but the rate of the non-photosensitive silver salt to the entirety is preferably 5 to 50% by weight, and more preferably, 10 to 30% by weight. It is preferable to use the dispersion promoter as described above, and it is preferable to use it in a minimum amount in a range suitable for minimizing the particle size, and it is preferable to set it 0.5 to 30% by weight and particularly, in a range of 1 to 15% by weight.

With this invention, the photosensitive material can be manufactured by mixing the non-photosensitive silver salt water dispersing liquid and the photosensitive sliver salt water dispersing liquid with each other. The mixing rate of the non-photosensitive silver salt and the photosensitive silver can be selected depending on the purpose, and the rate of the non-photosensitive silver salt to the photosensitive silver salt is preferably in a range of 1 to 30 mol %, more preferably, 3 to 20 mol %, and further preferably, 5 to 15 mol %. To mix two or more types of the non-photosensitive silver salt water dispersing liquids and two or more types of the photosensitive sliver salt water dispersing liquids with each other is a suitable method used for adjusting the photographic characteristics.

As for the photothermographic material according to the present invention, the non-photosensitive silver salt can be used in a desired amount, and a silver amount is preferably 0.1 to 5 g/m$^2$, more preferably, 1 to 3 g/m$^2$.

A metal ion or ions selected from Ca, Mg, Zn, and Ag can be preferably added to the non-photosensitive organic silver salt. An addition amount of the metal ion or ions is preferably $10^{-3}$ to $10^{-1}$ mol per one mol of the non-photosensitive silver salt, and more preferably, $5\times10^{-3}$ to $5\times10^{-2}$ mol. The addition of the metal ion or ions selected from Ca, Mg, Zn, and Ag to the non-photosensitive silver salt is preferably made in a form of not a halide, but a water-soluble metal salt, more specifically, in a form of a nitrate, a sulfite, or the like. Addition of halide is not preferable because image preservation property, in other words, printout property of the photosensitive material is made inferior due to light (e.g., room light or sun light) after the processing. As the metal ion or ions can be added any time, for example, after particle forming of the non-photosensitive silver salt, right after particle forming, before dispersion, after dispersion, and before or after preparation of the coating liquid, as far as it is right before the coating or earlier, and more preferably, it is after dispersion, or before or after preparation of the coating liquid.

In the photothermographic material according to the present invention, the photosensitive silver halide contained in the image forming layer is not limited as a halogen composition, and can be made of silver chloride, silver chlorobromide, silver bromide, silver iodobromide, and silver iodochlorobromide. The profile of the halogen composition in the particle can be uniform, changed stepwise in the halogen composition, or change continuously. Silver halide particles having a core or shell structure can be used preferably. As a structure, a structure of two to five layers is preferably used, and more preferably, core or shell particles of a structure of two to four layers is used. A technology in which silver bromide is located on surfaces of the particles of silver chloride or silver chlorobromide can be used preferably.

The method of forming photosensitive silver halide used for the present invention is well known in the art and, for example, the methods described in Research Disclosure, No. 17029 (June, 1978) and U.S. Pat. No. 3,700,458 may be used. Specifically, a method comprising adding a silver-supplying compound and a halogen-supplying compound to gelatin or other polymer solution to thereby prepare photosensitive silver halide and mixing the silver halide with a non-photosensitive silver salt may be used for the present invention. The photosensitive silver halide particle preferably has a small particle size so as to prevent high white turbidity after the formation of an image. Specifically, the particle size is preferably 0.20 $\mu$m or less, more preferably from 0.01 to 0.15 $\mu$m, still more preferably from 0.02 to 0.12 $\mu$m. The term "particle size" as used herein means the length of an ridge of the silver halide particle in the case where the silver halide particle is a regular crystal such as cubic or octahedral particle; the diameter of a circle image having the same area as the projected area of the main surface plane in the case where the silver halide particle is a tabular silver halide particle; or the diameter of a sphere having the same volume as the silver halide particle in the case of other irregular crystals such as spherical or bar particle.

Examples of the shape of the photosensitive silver halide particle include cubic form, octahedral form, tabular form, spherical form, stick form and bebble form, and among these, cubic particle and tabular particle are preferred in the present invention. When a tabular silver halide particle is used, the average aspect ratio is preferably from 100:1 to 2:1, more preferably from 50:1 to 3:1. A silver halide particle having rounded corners is also preferably used. The face index (Miller indices) of the outer surface plane of a photosensitive silver halide particle is not particularly limited; however, it is preferred that [100] faces capable of giving a high spectral sensitization efficiency upon adsorption of the spectral sensitizing dye occupy a high ratio. The ratio is preferably 50% or more, more preferably 65% or more, still more preferably 80% or more. The ratio of [100] faces according to the Miller indices can be determined by the method described in T. Tani, J. Imaging Sci., 29, 165 (1985) using the adsorption dependency of [111] face and [100] face upon adsorption of the sensitizing dye.

The photosensitive silver halide particle for use in the present invention may contain a metal or metal compound of Group VII or VIII (the $7^{th}$ to $10^{th}$ groups) in the Periodic Table. The center metal of the metal or metal compound of Group VII or VIII of the Periodic Table is preferably rhodium, rhenium, ruthenium, osnium or iridium. One kind of metal compound may be used or two or more kinds of compounds of the same metal or different metals may also be used in combination. The metal compound content is preferably from $1\times10^{-9}$ to $1\times10^{-3}$ mol, more preferably from $1\times10^{-8}$ to $1\times10^{-4}$ mol, per mol of silver. With respect to the specific example of the metal compound, the metal complexes having the structures described in JP-A-7-225, 449 may be raised.

As the rhodium compound mentioned in the above, a water-soluble rhodium compound may be used. Examples thereof include a rhodium(III) halogenide compounds and rhodium complex salts having a halogen, an amine or an oxalate as a ligand, such as hexachlororhodium(III) complex salt, pentachloroaquorhodium(III) complex salt, tetrachlorodiaquorhodium (III) complex salt, hexabromorhodium (III) complex salt, hexaamminerhodium(III) complex salt and trioxalatorhodium(III) complex salt. The rhodium compound is used after dissolving it in water or an appropriate solvent and a method commonly used for stabilizing the rhodium compound solution, that is, a method comprising adding an aqueous solution of hydrogen halogenide (e.g., hydrochloric acid, bromic acid, fluoric acid) or halogenated alkali (e.g., KCl, NaCl, KBr, NaBr) maybe used. In place of using a water-soluble rhodium, separate silver halide particles previously doped with rhodium may be added and dissolved at the time of preparation of silver halide.

The amount of the rhodium compound added is preferably from $1\times10^{-8}$ to $5\times10^{-6}$ mol, more preferably from $5\times10^{-8}$ to $1\times10^{-6}$ mol, per mol of sensitive silver halide.

The rhodium compound may be appropriately added at the time of production of sensitive silver halide emulsion particles or at respective stages before coating of the emulsion. However, the rhodium compound is preferably added at the time of formation of the emulsion and integrated into the silver halide particle.

The rhenium, ruthenium or osmium for use in the present invention is added in the form of a water-soluble complex salt described in JP-A-63-2042, JP-A-1-285941, JP-A-2-20852 and JP-A-2-20855. A preferred example thereof is a six-coordinate complex represented by the following formula:

$$[ML_6]^{n-}$$

wherein M represents Ru, Re or Os, L represents a ligand, and n represents 0, 1, 2, 3 or 4.

In this case, the counter ion plays no important role and an ammonium or alkali metal ion is used.

Preferred examples of the ligand include a halide ligand, a cyanide ligand, a cyan oxide ligand, a nitrosyl ligand and a thionitrosyl ligand. Specific examples of the complex for use in the present invention are shown below, but the present invention is by no means limited thereto.

| | | |
|---|---|---|
| $[ReCl_6]^{3-}$ | $[ReBr_6]^{3-}$ | $[ReCl_5(NO)]^{2-}$ |
| $[Re(NS)Br_5]^{2-}$ | $[Re(NO)(CN)_5]^{2-}$ | $[Re(O)_2(CN)_4]^{3-}$ |
| $[RuCl_6]^{3-}$ | $[RuCl_4(H_2O)_2]^{-}$ | $[RuCl_5(H_2O)]^{2-}$ |
| $[RuCl_5(NO)]^{2-}$ | $[RuBr_5(NS)]^{2-}$ | |
| $[Ru(CO)_3Cl_3]^{2-}$ | $[Ru(CO)Cl_5]^{2-}$ | $[Ru(CO)Br_5]^{2-}$ |
| $[OsCl_6]^{3-}$ | $[OsCl_5(NO)]^{2-}$ | $[Os(NO)(CN)_5]^{2-}$ |
| $[Os(NS)Br_5]^{2-}$ | $[Os(O)_2(CN)_4]^{4-}$ | |

The addition amount of these compounds is preferably from $1\times10^{-9}$ to $1\times10^{-4}$ mol, more preferably from $1\times10^{-5}$ to $1\times10^{-5}$ mol, per mol of photosensitive silver halide.

These compounds may be added appropriately at the time of preparation of photosensitive silver halide emulsion particles or at respective stages before coating of the emulsion, but the compounds are preferably added at the time of formation of the emulsion and integrated into a silver halide particle.

For adding the compound during the particle formation of silver halide and integrating it into a silver halide particle, a method where a metal complex powder or an aqueous solution having dissolved therein the metal complex together with NaCl or KCl is added to a water-soluble salt or water-soluble halide solution during the particle formation, a method where the compound is added as the third solution at the time of simultaneously mixing a silver salt and a halide solution to prepare silver halide particles by the triple jet method, or a method where a necessary amount of an aqueous metal complex solution is poured into a reaction vessel during the particle formation, may be used. Among these, preferred is a method comprising adding a metal complex powder or an aqueous solution having dissolved therein the metal complex together with NaCl or KCl to a water-soluble halide solution.

In order to add the compound to the particle surface, a necessary amount of an aqueous metal complex solution may be charged into a reaction vessel immediately after the particle formation, during or after completion of the physical ripening, or at the time of chemical ripening.

As the iridium compound for use in the present invention, various compounds may be used, and examples thereof include hexachloroiridium, hexammineiridium, trioxalatoiridium, hexacyanoiridium and pentachloronitrosyliridium. The iridium compound is used after dissolving it in water or an appropriate solvent, and a method commonly used for stabilizing the iridium compound solution, more specifically, a method comprising adding an aqueous solution of hydrogen halogenide (e.g., hydrochloric acid, bromic acid, fluoric acid) or halogenated alkali (e.g., KCl, NaCl, KBr, NaBr) may be used. In place of using a water-soluble iridium, separate silver halide particles previously doped with iridium may be added and dissolved at the time of preparation of silver halide.

The photosensitive silver halide particle for use in the present invention may further containametal atom such as cobalt, iron, nickel, chromium, palladium, platinum, gold, thallium, copper and lead. In the case of cobalt, iron, chromium or ruthenium compound, a hexacyano metal complex is preferably used. Specific examples thereof include ferricyanate ion, ferrocyanate ion, hexacyanocobaltate ion, hexacyanochromate ion and hexacyanoruthenate ion. However, the present invention is by no means limited thereto. The phase of the silver halide, in which the metal complex is contained, is not particularly limited, and the phase may be uniform or the metal complex may be contained in a higher concentration in the core part or in the shell part.

The above-described metal is used preferably in an amount of from $1\times10^{-9}$ to $1\times10^{-4}$ mol per mol of photosensitive silver halide. The metal may be converted into a metal salt in the form of a simple salt, a composite salt or a complex salt and added at the time of preparation of particles.

The photosensitive silver halide particle may be desalted by water washing according to a method known in the art, such as noodle washing and flocculation, but the particle may not be desalted in the present invention.

As a gold sensitizer used when the photosensitive silver halide emulsion of the invention is subject to gold sensitization, gold compound used ordinarily as a gold sensitizer having an oxidation number of monovalent or trivalent can be used. As representative examples, chroloaurate , potassium chroloaurate, aurictrichloride, potassium auricthiocyanate, potassium iodoaurate, tetracyanoauric acid, ammonium aurothiocyanate, pyrdyltrichlorogold, and the like are exemplified.

The addition amount of the gold sensitizer may vary depending on each condition, and as a standard, it is $10^{-7}$ mol or higher and $10^{-3}$ mol or lower per one mol of the silver halide, and more preferably, it is $10^{-6}$ mol or higher and $5\times10^{-4}$ mol or lower.

It is preferable to use together the gold sensitization and other chemical sensitizations for the photosensitive silver halide emulsion of the invention. As other chemical sensitizations, the chemical sensitization may be performed using a known method such as sulfur sensitization, selenium sensitization, tellurium sensitization or noble metal sensitization. The sensitization method may be used alone or in any combination. When these sensitization methods are used as a combination, a combination of sulfur sensitization and gold sensitization, a combination of sulfur sensitization, selenium sensitization and gold sensitization, a combination of sulfur sensitization, tellurium sensitization and gold sensitization, and a combination of sulfur sensitization, selenium sensitization, tellurium sensitization and gold sensitization, for example, are preferred.

The sulfur sensitization preferably used in the present invention is usually performed by adding a sulfur sensitizer and stirring the emulsion at a high temperature of 40° C. or higher for a predetermined time. The sulfur sensitizer may be a known compound and examples thereof include, in addition to the sulfur compound contained in gelatin, various sulfur compounds such as thiosulfates, thioureas, thiazoles and rhodanines. Preferred sulfur compounds are a thiosulfate and a thiourea compound. The amount of the sulfur sensitizer added varies depending upon various conditions such as the pH and the temperature at the chemical ripening and the size of silver halide grain. However, it is preferably from $10^{-7}$ to $10^{-2}$ mol, more preferably from $10^{-5}$ to $10^{-3}$ mol, per mol of silver halide.

As the selenium sensitizer, a known selenium compound may be used. That is, the selenium sensitization is usually performed by adding a labile and/or non-labile selenium compound and stirring the emulsion at a high temperature of 40° C. or higher for a predetermined time. Examples of the labile selenium compound include the compounds described in Japanese Patent Publication (hereinafter referred to as "JP-B-") Showa No. 44-15748, JP-B-43-13489, JP-A-4-25832, JP-A-4-109240 and JP-A-3-121798. Among these, particularly preferred are the compounds represented by formulae (VIII) and (IX) of JP-A-4-324855.

The tellurium sensitizer is a compound of forming silver telluride presumed to work out to a sensitization nucleus, on the surface or in the inside of a silver halide grain. The rate of the formation of silver telluride in a silver halide emulsion can be examined according to a method described in JP-A-5-313284. Examples of the tellurium sensitizer include diacyl tellurides, bis(oxycarbonyl)tellurides, bis(carbamoyl) tellurides, diacyl tellurides, bis(oxycarbonyl)ditellurides, bis (carbamoyl) ditellurides, compounds having a P=Te bond, tellurocarboxylates, Te-organyltellurocarboxylic acid esters, di(poly)tellurides, tellurides, tellurols, telluroacetals, tellurosulfonates, compounds having a P-Te bond, Te-containing heterocyclic rings, tellurocarbonyl compounds, inorganic tellurium compounds and colloidal tellurium. Specific examples thereof include the compounds described in U.S. Pat. Nos. 1,623,499, 3,320,069 and 3,772,031, British Patent Nos. 235,211, 1,121,496, 1,295,462 and 1,396,696, Canadian Patent No. 800,958, JP-A-4-204640, JP-A-3-53693, JP-A-4-271341, JP-A-4-333043, JP-A-5-303157, J. Chem. Soc. Chem. Commun., 635 (1980), ibid., 1102 (1979), ibid., 645 (1979), J. Chem. Soc. Perkin. Trans., 1, 2191 (1980), S. Patai (compiler), The Chemistry of Organic Selenium and Tellurium Compounds, Vol. 1 (1986), and ibid., Vol. 2 (1987). The compounds represented by formulae (II), (III) and (IV) of JP-A-5-313284 are particularly preferred.

The amount of the selenium or tellurium sensitizer used in the present invention varies depending on silver halide grains used or chemical ripening conditions. However, it is usually from $10^{-8}$ to $10^{-2}$ mol, preferably on the order of from $10^{-7}$ to $10^{-3}$ mol, per mol of silver halide.

The conditions for chemical sensitization in the present invention are not particularly restricted. However, in general, the pH is from 5 to 8, the pAg is from 6 to 11, preferably from 7 to 10, and the temperature is from 40 to 95° C., preferably from 45 to 85° C.

In the silver halide emulsion for use in the present invention, a cadmium salt, sulfite, lead salt or thallium salt may be allowed to be present together during formation or physical ripening of silver halide grains.

In the present invention, reduction sensitization may be used. Specific examples of the compound used in the reduction sensitization include an ascorbic acid, thiourea dioxide, stannous chloride, aminoiminomethanesulfinic acid, a hydrazine derivative, a borane compound, a silane compound and a polyamine compound. The reduction sensitization may be performed by ripening the grains while keeping the emulsion at a pH of 7 or more or at a pAg of 8.3 or less. Also, the reduction sensitization may be performed by introducing a single addition part of silver ion during the formation of grains.

To the silver halide emulsion of the present invention, a thiosulfonic acid compound may be added by the method described in European Patent 293917A.

In the photothermographic material of the present invention, one kind of silver halide emulsion may be used or two or more kinds of silver halide emulsions (for example, those different in the average grain size, different in the halogen composition, different in the crystal habit or different in the chemical sensitization conditions) may be used in combination.

The amount of the photosensitive silver halide used in the present invention is preferably from 0.01 to 0.5 mol, more preferably from 0.02 to 0.3 mol, still more preferably from 0.03 to 0.25 mol, per mol of the non-photosensitive silver salt. The method and conditions for mixing photosensitive silver halide and non-photosensitive silver salt which are prepared separately are not particularly limited as far as the effect of the present invention can be brought out satisfactorily. However, a method of mixing the silver halide grains and the non-photosensitive silver salt after completion of respective preparations in a high-speed stirring machine, a ball mill, a sand mill, a colloid mill, a vibrating mill or a homogenizer or the like, or a method involving preparing non-photosensitive silver salt while mixing therewith photosensitive silver halide after completion of the preparation in any time during preparation of the non-photosensitive silver salt, or the like may be used.

In the photothermographic material of the invention, the image forming layer contains nucleation agent. As for the nucleation agent, preferably used are substituted alkene derivatives, substituted isooxazole derivatives, and specific acetal compounds. In order to obtain more contrast image, usable is at least one compound selected from a group consisting of:

a substituted alkene derivative represented by following Formula (3),

Formula (3)

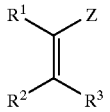

(where $R^1$, $R^2$ and $R^3$ each independently represents a hydrogen atom or a substituent, Z represents an electron withdrawing group or a silyl group, and $R^1$ and Z, $R^2$ and $R^3$, $R^1$ and $R^2$, and/or $R^3$ and Z may be combined with each other to form a ring), a substituted isoxazole derivative represented by following Formula (4), Formula (4)

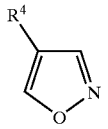

(where $R^4$ represents a substituent), and an acetal compound represented by following Formula (5), Formula (5)

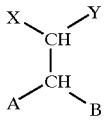

(where X and Y each independently represents a hydrogen atom or a substituent, A and B each independently represents an alkoxyl group, an alkylthio group, an alkylamino group, an aryloxy group, an arylthio group, an anilino group, a heterocyclic oxy group, a heterocyclic thio group or a heterocyclic amino group, and X and Y, or A and B may be combined with each other to form a ring structure)

First, the substituted alkene derivative represented by Formula (3) is described in detail below. In Formula (3), $R^1$, $R^2$ and $R^3$ each independently represents a hydrogen atom or a substituent, and Z represents an electron withdrawing group or a silyl group. $R^1$ and Z, $R^2$ and $R^3$, $R^1$ and $R^2$, and/or $R^3$ and Z may be combined with each other to form a ring.

When $R^1$, $R^2$ or $R^3$ represents a substituent, examples of the substituent include a halogen atom, e.g., fluorine, chlorine, bromide, iodine, an alkyl group (including an aralkyl group, a cycloalkyl group and active methine group), an alkenyl group, an alkynyl group, an aryl group, a heterocyclic group (including N-substituted nitrogen-containing heterocyclic group), a quaternized nitrogen-containing heterocyclic group, e.g., pyridinio group, an acyl group, an alkoxycarbonyl group, an aryloxycarbonyl group, a carbamoyl group, a carboxy group or a salt thereof, an imino group, an imino group substituted by N atom, a thiocarbonyl group, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group (or a salt thereof), an alkoxy group (including a group containing an ethyleneoxy group or propyleneoxy group repeating unit), an aryloxy group, a heterocyclic oxy group, an acyloxy group, a carbonyloxy group which might be substituted by alkoxy or aryloxy, a carbamoyloxy group, a sulfonyloxy group, an amino group, an alkyl amino group, aryl amino group, heterocyclic amino group, an acylamino group, a sulfonamido group, a ureido group, a thioureido group, an imido group, a carbonylamino group which might be substituted by alkoxy or aryloxy, a sulfamoylamino group, a semicarbazide group, a thiosemicarbazide group, a hydrazino group, a quaternary ammonio group, an oxamoylamino group, a sulfonylureido group which might be substituted by alkyl or aryl, an acylureido group, an acylsulfamoylamino group, a nitro group, a mercapto group, an alkyl thio group, aryl thio group, heterocyclic thio group, an acylthio group, a sulfonyl group which might be substituted by alkyl or aryl, a sulfinyl group which might be substituted by alkyl or aryl, a sulfo group or a salt thereof, a sulfamoyl group, an acylsulfamoyl group, a sulfonylsulfamoyl group and a salt thereof, a phosphoryl group, a group containing phosphoramide or phosphoric acid ester structure, a silyl group and a stannyl group. These substituents each may further be substituted by any of the above-described substituents.

When $R^1$, $R^2$ or $R^3$ represent substituents, preferably a group has a total carbon atom number of from 0 to 30, and specific examples of the group include a group having the same meaning as the electron withdrawing group represented by Z in Formula (3) mentioned below, an alkyl group, a hydroxy group and a salt thereof, a mercapto group and a salt thereof, an alkoxy group, an aryloxy group, a heterocyclic oxy group, an alkylthio group, an arylthio group, a heterocyclic thio group, an amino group, an alkylamino group, an arylamino group, a heterocyclic amino group, a ureido group, an acylamino group, a sulfonamido group and a substituted or unsubstituted aryl group.

$R^1$ is preferably an electron withdrawing group, an aryl group, an alkylthio group, an alkoxy group, an acylamino group, a hydrogen atom or a silyl group.

When $R^1$ represents an electron withdrawing group, the electron withdrawing group is preferably a group having a total carbon atom number of from 0 to 30 such as a cyano group, a nitro group, an acyl group, a formyl group, an alkoxycarbonyl group, an aryloxycarbonyl group, a thiocarbonyl group, an imino group, animino group substituted by N atom, an alkylsulfonyl group, an arylsulfonyl group, a carbamoyl group, a sulfamoyl group, a trifluoromethyl group, a phosphoryl group, a carboxy group and a salt thereof, a saturated and unsaturated heterocyclic group, more preferably a cyano group, an acyl group, a formyl group, an alkoxycarbonyl group, a carbamoyl group, an imino group, an imino group substituted by N atom, a sulfamoyl group, a carboxy group and a salt thereof or a saturated or unsaturated heterocyclic group, still more preferably a cyano group, a formyl group, an acyl group, an alkoxycarbonyl group, a carbamoyl group or a saturated or unsaturated heterocyclic group.

As for $R^1$, the aryl group is preferably a substituted or unsubstituted phenyl group having a total carbon atom number of from 6 to 30. The substituent may be any substituent but an electron withdrawing substituent is preferred. $R^1$ is more preferably an electron withdrawing group or an aryl group.

When $R^2$ and $R^3$represent substitutents in Formula (3), preferable is the electron withdrawing group represented by Z in Formula (3) described below, an alkyl group, a hydroxy group and a salt thereof, a mercapto group and a salt thereof, an alkoxy group, an aryloxy group, a heterocyclic oxy group, an alkylthio group, an arylthio group, a heterocyclic thio group, an amino group, an alkylamino group, an anilino group, a heterocyclic amino group, an acylamino group or a substituted or unsubstituted phenyl group.

It is more preferred that one of $R^2$ and $R^3$ is a hydrogen atom and the other is a substituent. The substituent is preferably an alkyl group, a hydroxy group or a salt thereof, a mercapto group or a salt thereof, an alkoxy group, an aryloxy group, a heterocyclic oxy group, an alkylthio group, an arylthio group, a heterocyclic thio group, an amino group, an alkylamino group, an anilino group, a heterocyclic amino group, an acylamino group (particularly, a perfluoroalkanamido group), a sulfonamido group, a substituted or unsubstituted phenyl group or a heterocyclic group, more preferably a hydroxy group (or a salt thereof), a mercapto group or a salt thereof, an alkoxy group, an aryloxy group, a heterocyclic oxy group, an alkylthio group, an arylthio group, a heterocyclic thio group or a heterocyclic group, still more preferably a hydroxy group or a salt thereof, an alkoxy group or a heterocyclic group.

In Formula (3), Z represents an electron withdrawing group or a silyl group, but preferable is an electron withdrawing group.

The electron withdrawing group represented by Z is a substituent having a Hammett's substituent constant σp of a positive value, and specific examples thereof include a cyano group, an alkoxycarbonyl group, an aryloxycarbonyl group, a carbamoyl group, an imino group, an imino group substituted by N atom, a thiocarbonyl group, a sulfamoyl group, an alkylsulfonyl group, an arylsulfonyl group, a nitro group, a halogen atom, a perfluoroalkyl group, a perfluoroalkanamido group, a sulfonamido group, an acyl group, a formyl group, a phosphoryl group, a carboxy group or a salt thereof, a sulfo group and a salt thereof, a heterocyclic group, an alkenyl group, an alkynyl group, an acyloxy group, an acylthio group, a sulfonyloxy group and an aryl group substituted by the above-described electron withdrawing group. The heterocyclic group is a saturated or unsaturated heterocyclic group and examples thereof include a pyridyl group, a quinolyl group, a pyrazinyl group, a quinoxalinyl group, a benzotriazolyl group, an imidazolyl group, a benzimidazolyl group, a hydantoin-1-yl group, a succinimido group and a phthalimido group. The aforementioned electron withdrawing group may further have a substituent and examples of the substituent include those described for the substituent which the substituent represented by $R^1$, $R^2$ or $R^3$ in Formula (3) may have.

When Z represents the electron withdrawing group, the electron withdrawing group is preferably a group having a total carbon atom number of from 0 to 30 such as a cyano group, an alkoxycarbonyl group, an aryloxycarbonyl group, a carbamoyl group, a thiocarbonyl group, an imino group, an imino group substituted by N atom, a sulfamoyl group, an alkylsulfonyl group, an arylsulfonyl group, a nitro group, a perfluoroalkyl group, an acyl group, a formyl group, a phosphoryl group, an acyloxy group, an acylthio group or a phenyl group substituted by any electron withdrawing group, more preferably a cyano group, an alkoxycarbonyl group, a carbamoyl group, an imino group, a sulfamoyl group, an alkylsulfonyl group, an arylsulfonyl group, an acyl group, a formyl group, a phosphoryl group, a trifluoromethyl group or aphenyl group substituted by any electron withdrawing group, still more preferably a cyano group, a formyl group, an acyl group, an alkoxycarbonyl group, an imino group or a carbamoyl group.

The silyl group represented by Z in Formula (3) is preferably a trimethylsilyl group, a t-butyldimethylsilyl group, a phenyldimethylsilyl group, a triethylsilyl group, a triisopropylsilyl group or a trimethylsilyldimethylsilyl group.

In Formula (3), $R^1$ and Z, $R^2$ and $R^3$, $R^1$ and $R^2$, and/or $R^3$ and Z may be combined with each other to form a ring, but preferably Z and $R^1$ or $R^2$ and $R^3$ are combined with each other to form a ring. The ring structure formed in this time is a non-aromatic carbocyclic ring or a non-aromatic heterocyclic ring, preferably a 5-, 6- or 7-membered ring having a total carbon atom number including those of substituents of from 1 to 40, more preferably from 3 to 30.

The compound represented by Formula (3) is more preferably a compound where Z represents a cyano group, a formyl group, an acyl group, an alkoxycarbonyl group, an imino group or a carbamoyl group, $R^1$ represents an electron withdrawing group or an aryl group, and one of $R^2$ and $R^3$ represents a hydrogen atom and the other represents a hydroxy group or a salt thereof, a mercapto group or a salt thereof, an alkoxy group, an aryloxy group, a heterocyclic oxy group, an alkylthio group, an arylthio group, a heterocyclic thio group or a heterocyclic group.

The compound represented by Formula (3) is still more preferably a compound where Z and $R^1$ form a non-aromatic 5-, 6- or 7-membered ring and one of $R^2$ and $R^3$ represents a hydrogen atom and the other represents a hydroxy group or a salt thereof, a mercapto group or a salt thereof, an alkoxy group, an aryloxy group, a heterocyclic oxy group, an alkylthio group, an arylthio group, a heterocyclic thio group or a heterocyclic group. At this time, Z which forms a non-aromatic ring structure together with $R^1$ is preferably an acyl group, a carbamoyl group, an oxycarbonyl group, a thiocarbonyl group or a sulfonyl group and $R^1$ is preferably an acyl group, a carbamoyl group, an oxycarbonyl group, a thiocarbonyl group, a sulfonyl group, an imino group, an imino group substituted by N atom, an acylamino group or a carbonylthio group.

The substituted isoxazole derivative represented by Formula (4) will be described below.

In Formula (4), $R^4$ represents a substituent. Examples of the substituent represented by $R^4$ include those described for the substituent represented by $R^1$, $R^2$ or $R^3$ in Formula (3).

The substituent represented by $R^4$ is preferably an electron withdrawing group or an aryl group. When $R^4$ represents an electron withdrawing group, the electron withdrawing group is preferably a group having a total carbon atom number of from 0 to 30 such as a cyano group, a nitro group, an acyl group, a formyl group, an alkoxycarbonyl group, an aryloxycarbonyl group, an alkylsulfonyl group, an arylsulfonyl group, a carbamoyl group, a sulfamoyl group, a trifluoromethyl group, a phosphoryl group, an imino group or a saturated or unsaturated heterocyclic group, more preferably a cyano group, an acyl group, a formyl group, an alkoxycarbonyl group, a carbamoyl group, a sulfamoyl group, an alkylsulfonyl group, an arylsulfonyl group or a heterocyclic group, still more preferably a cyano group, a formyl group, an acyl group, an alkoxycarbonyl group, a carbamoyl group or a heterocyclic group.

When $R^4$ represents an aryl group, the aryl group is preferably a substituted or unsubstituted phenyl group having a total carbon atom number of from 0 to 30. Examples of the substituent include those described for the substituent represented by $R^1$, $R^2$ or $R^3$ in Formula (3).

$R^4$ is more preferably a cyano group, an alkoxycarbonyl group, a carbamoyl group, a heterocyclic group or a substituted or unsubstituted phenyl group, most preferably a cyano group, a heterocyclic group or an alkoxycarbonyl group.

Next, an acetal compound represented by following Formula (5) will be described in detail below.

In Formula (5), X and Y each independently represents a hydrogen atom or a substituent, and A and B each independently represents an alkoxy group, an alkylthio group, an alkylamino group, an aryloxy group, an arylthio group, an anilino group, a heterocyclic thio group, a heterocyclic oxy group or a heterocyclic amino group, and X and Y or A and B may be combined with each other to form a ring.

Examples of the substituent represented by X or Y in Formula (5) include those described for the substituent represented by $R^1$, $R^2$ or $R^3$ in Formula (3). Specific examples thereof include an alkyl group (including a perfluoroalkyl group and a trichloromethyl group), an aryl group, a heterocyclic group, a halogen atom, a cyano group, a nitro group, an alkenyl group, an alkynyl group, an acyl group, a formyl group, an alkoxycarbonyl group, an aryloxycarbonyl group, an imino group, an imino group substituted by N atom, a carbamoyl group, a thiocarbonyl group, an acyloxy group, an acylthio group, an acylamino group, an alkylsulfonyl group, an arylsulfonyl group, a sulfamoyl group, a phosphoryl group, a carboxy group and a salt thereof, a sulfo group and a salt thereof, a hydroxy group and a salt thereof, a mercapto group and a salt thereof, an alkoxy group, an aryloxy group, a heterocyclic oxy group, an alkylthio group, an arylthio group, a heterocyclic thio group, an amino group, an alkylamino group, an anilino group, a heterocyclic amino group and a silyl group. These groups each may further have a substituent.

In addition, X and Y may be combined with each other to form a ring shape and the ring formed may be either a non-aromatic carbocyclic ring or a non-aromatic heterocyclic ring.

When X and Y each represents a substituent, the substituent is preferably a substituent having a total carbon atom number of from 1 to 40, more preferably from 1 to 30, such as a cyano group, an alkoxycarbonyl group, an aryloxycarbonyl group, a carbamoyl group, an imino group, an imino group substituted by N atom, a thiocarbonyl group, a sulfamoyl group, an alkylsulfonyl group, an arylsulfonyl group, a nitro group, a perfluoroalkyl group, an acyl group, a formyl group, a phosphoryl group, an acylamino group, an acyloxy group, an acylthio group, a heterocyclic group, an alkylthio group, an alkoxy group or an aryl group.

X and Y each is more preferably a cyano group, a nitro group, an alkoxycarbonyl group, a carbamoyl group, an acyl group, a formyl group, an acylthio group, an acylamino group, a thiocarbonyl group, a sulfamoyl group, an alkylsulfonyl group, an arylsulfonyl group, an imino group, an imino group substituted by N atom, a phosphoryl group, a trifluoromethyl group, a heterocyclic group or a substituted phenyl group, still more preferably a cyano group, an alkoxycarbonyl group, a carbamoyl group, an alkylsulfonyl group, an arylsulfonyl group, an acyl group, an acylthio group, an acylamino group, a thiocarbonyl group, a formyl group, an amino group, an imino group substituted by N atom, a heterocyclic group or a phenyl group substituted by any electron withdrawing group.

X and Y are also preferably combined with each other to form a non-aromatic carbocyclic ring or a non-aromatic heterocyclic ring. The ring formed is preferably a 5-, 6- or 7-membered ring having a total carbon atom number of from 1 to 40, more preferably from 3 to 30. X and Y for forming a ring each is preferably an acyl group, a carbamoyl group, an oxycarbonyl group, a thiocarbonyl group, a sulfonyl group, an imino group, an imino group substituted by N atom, an acylamino group or a carbonylthio group.

A and B each independently represents an alkoxy group, an alkylthio group, an alkylamino group, an aryloxy group, an arylthio group, an anilino group, a heterocyclic thio group, a heterocyclic oxy group or a heterocyclic amino group, which may be combined with each other to form a ring.

Those represented by A and B are preferably a group having a total carbon atom number of from 1 to 40, more preferably from 1 to 30, and the group may further have a substituent.

A and B are more preferably combined with each other to form a ring. The ring formed is preferably a 5-, 6- or 7-membered non-aromatic heterocyclic ring having a total carbon atom number of from 1 to 40, more preferably from 3 to 30. Examples of the linked structure (—A—B—) formed by A and B include —O—$(CH_2)_2$—O—, —O—$(CH_2)_3$—O—, —S—$(CH_2)_2$—S—, —S—$(CH_2)_3$—S—, —S—ph—S—, —N$(CH_3)$—$(CH_2)_2$—O—, —N$(CH_3)$—$(CH_2)_2$—S—, —O—$(CH_2)_2$—S—, —O—$(CH_2)_3$—S—, —N$(CH_3)$—ph—O—, —N$(CH_3)$—ph—S— and —N(ph)—$(CH_2)_2$—S—.

Into the compound represented by Formula (3), (4) or (5) for use in the present invention as a desired nucleation agent, an adsorptive group capable of adsorbing to silver halide may be integrated. Examples of the adsorptive group include the groups described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245and JP-A-63-234246, such as an alkylthio group, an arylthio group, a thiourea group, a thioamide group, a mercaptoheterocyclic group and a triazole group. The adsorptive group may be formed into a precursor. Examples of the precursor include the groups described in JP-A-2-285344.

Into the compound represented by Formula (3), (4) or (5) for use in the present invention, a ballast group or polymer commonly used in immobile photographic additives such as a coupler may be integrated, preferably a ballast group is incorporated. The ballast group is a group having 8 or more carbon atoms and being relatively inactive to the photographic properties. Examples of the ballast group include an alkyl group, an aralkyl group, an alkoxy group, a phenyl group, an alkylphenyl group, a phenoxy group and an alkylphenoxy group. Examples of the polymer include those described in JP-A-1-100530.

The compound represented by Formula (3), (4) or (5) for use in the present invention may contain a cationic group (specifically, a group containing a quaternary ammonio group or a nitrogen-containing heterocyclic group containing a quaternized nitrogen atom), a group containing an ethyleneoxy group or a propyleneoxy group as a repeating unit, an (alkyl, aryl or heterocyclic) thio group, or a dissociative group capable of dissociation by a base (e.g., carboxy group, sulfo group, acylsulfamoyl group, carbamoylsulfamoyl group), preferably a group containing an ethyleneoxy group or a propyleneoxy group as a repeating unit, or an (alkyl, aryl or heterocyclic)thio group. Specific examples of these groups include the compounds described in JP-A-7-234471, JP-A-5-333466, JP-A-6-19032, JP-A-6-19031, JP-A-5-45761, U.S. Pat. Nos. 4,994,365 and 4,988,604, JP-A-3-259240, JP-A-7-5610, JP-A-7-244348 and German Patent No. 4,006,032.

Specific examples of the compounds represented by Formulae (1) to (3) for use as a desired nucleation agent in the present invention are shown below. However, the present invention is by no means limited to the following compounds.

C-1

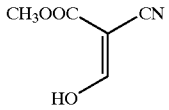

C-2

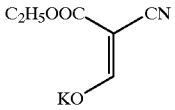

C-3

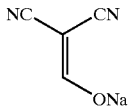

C-4

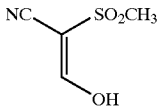

C-5

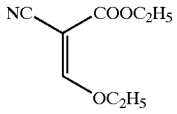

C-6

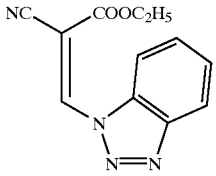

C-7

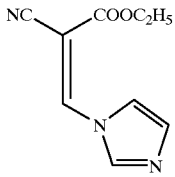

C-8

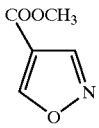

C-9

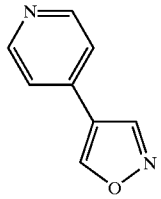

C-10

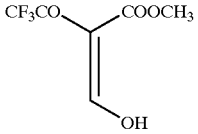

-continued
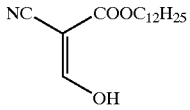
C-11
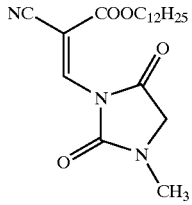
C-12
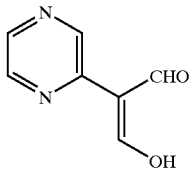
C-13
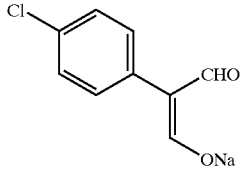
C-14
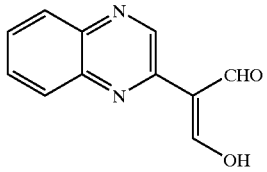
C-15
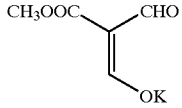
C-16
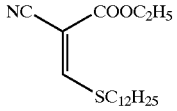
C-17
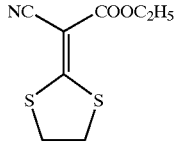
C-18
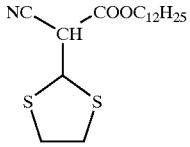
C-19
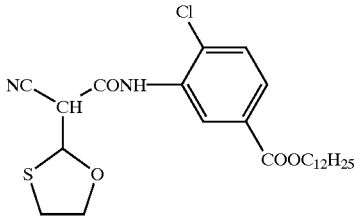
C-20
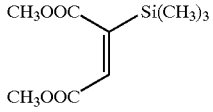
C-21
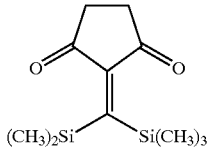
C-22
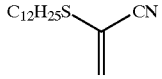
C-23
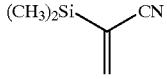
C-24
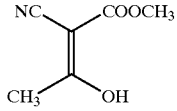
C-25
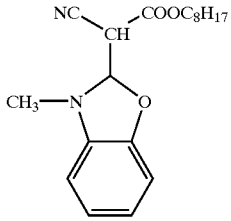
C-26
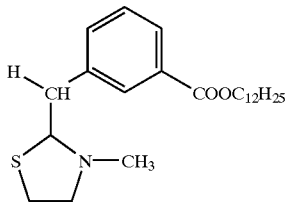
C-27

-continued
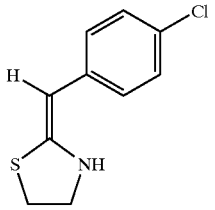
C-28
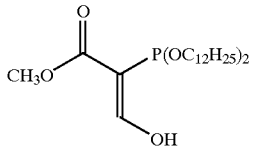
C-29
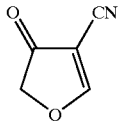
C-30
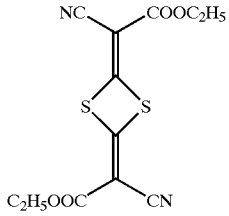
C-31
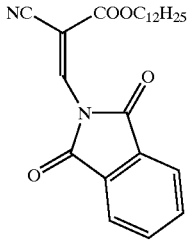
C-32
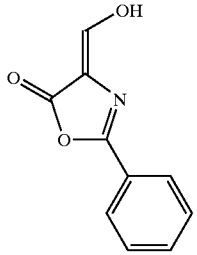
C-33
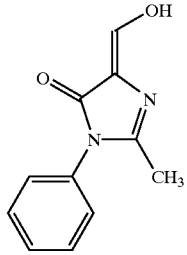
C-34
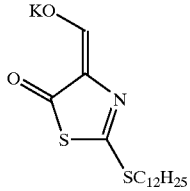
C-35
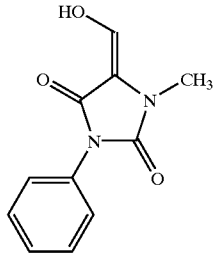
C-36
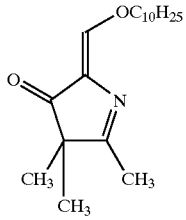
C-37
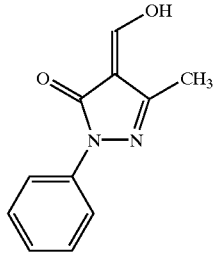
C-38
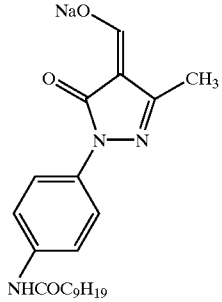
C-39

-continued
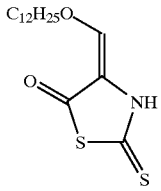
C-40
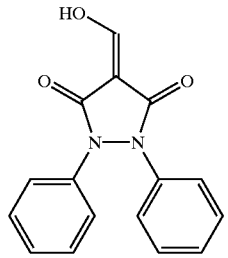
C-41
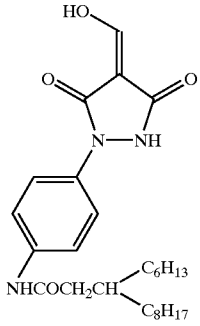
C-42
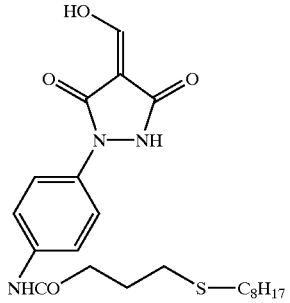
C-43
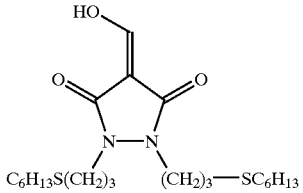
C-44
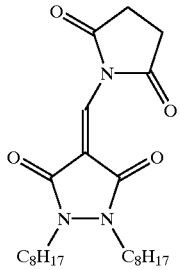
C-45
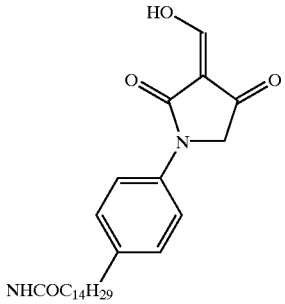
C-46
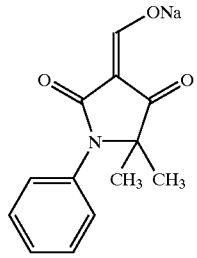
C-47
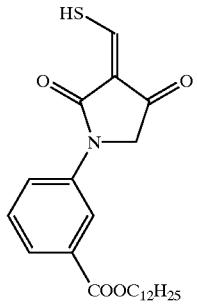
C-48
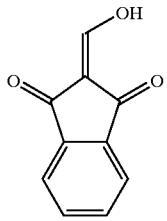
C-49

-continued
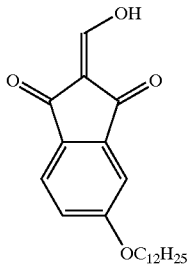
C-50
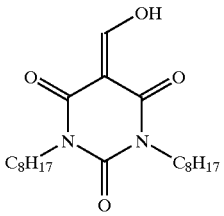
C-51
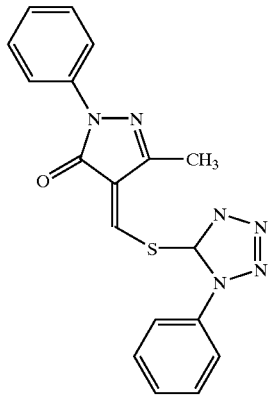
C-52
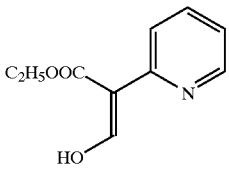
C-53
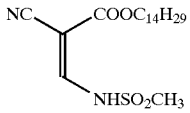
C-54
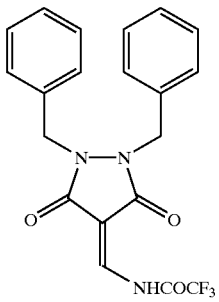
C-55
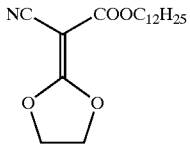
C-56
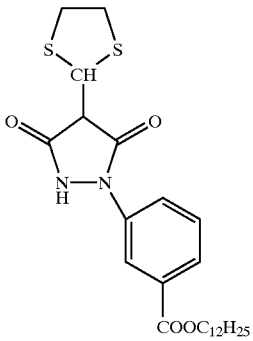
C-57

-continued
C-58
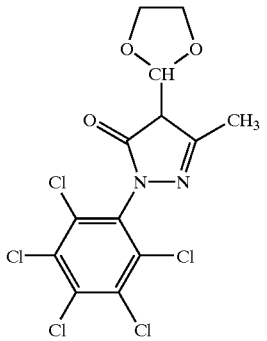
C-59
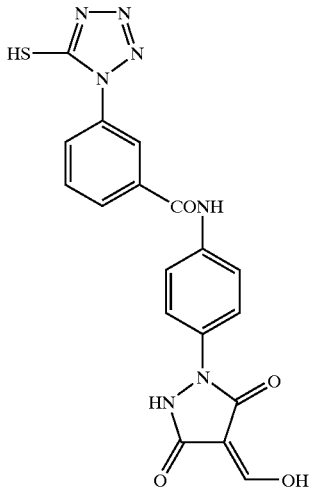
C-60
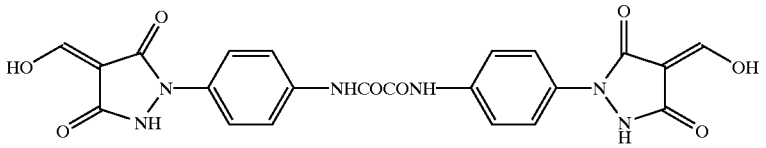
C-61
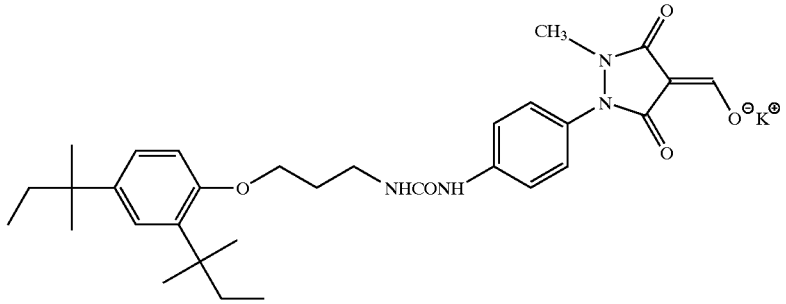
C-62
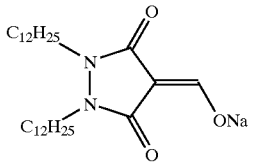
C-63
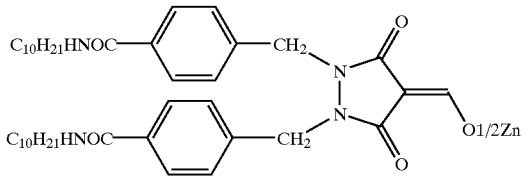
C-64
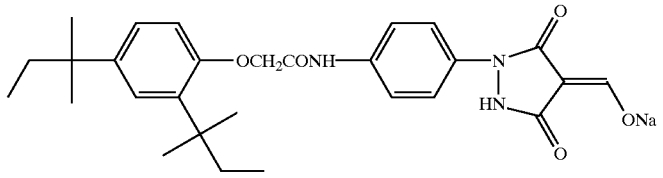

The compounds represented by formulae (3) to (5) used as a desired nucleation agent in the present invention can be easily synthesized according to known methods and may be synthesized by referring, for example, to U.S. Pat. Nos. 5,545,515, 5,635,339 and 5,654,130, International Patent Publication WO97/34196 or JP-A-9-354107, 9-309813 and 9-272002.

The compounds represented by Formulae (3) to (5) may be used individually or in combination of two or more thereof. In addition to these compounds, a compound described in U.S. Pat. Nos. 5,545,515, 5,635,339 and 5,654,130, International Patent Publication WO97/34196, U.S. Pat. No. 5,686,228 or JP-A-8-279962, 9-228881, 9-273935, 9-354107, 9-309813, 9-296174, 9-282564, 9-272002, 9-272003 and 9-332388 may also be used in combination.

The addition amount of the compound represented by Formula (3), (4) or (5) is preferably from $1\times10^{-6}$ to 1 mol, more preferably from $1\times10^{-5}$ to $5\times10^{-1}$ mol, still more preferably from $2\times10^{-5}$ to $2\times10^{-1}$ mol, per mol of silver.

The compounds represented by Formulae (3) to (5) each may be used after dissolving it in water or an appropriate organic solvent such as an alcohol including methanol, ethanol, propanol, fluorinated alcohol or the like, a ketone including acetone, methyl ethyl ketone or the like, dimethylformamide, dimethylsulfoxide or methyl cellosolve.

Also, the compounds each may be dissolved by an already well-known emulsification dispersion method using an oil such as dibutyl phthalate, tricresyl phosphate, glyceryl triacetate or diethyl phthalate, or an auxiliary solvent such as ethyl acetate or cyclohexanone, and mechanically formed into an emulsified dispersion before use. Also, the compounds each may be used after dispersing the powder of the compound in an appropriate solvent such as water by a method known as a solid dispersion method, using a ball mill, a colloid mill or an ultrasonic wave.

The compounds represented by Formulae (3) to (5) each may be added to any layers on the image recording layer side with respect to the support, but preferably added to an image forming layer or a layer adjacent thereto.

In the photothermographic material according to the present invention, hydrazine derivatives as a nucleation agent contained in the image forming layer may be used, and further the above nucleation agent represented by the above Formulae (3) to (5) and hydrazine derivatives can used concurrently. In such a case, the hydrazine derivatives described below may also be preferably used. The hydrazine derivatives used in this invention can be synthesized by various methods described in the following patent publications.

Examples of the hydrazine derivative other than the hydrazine derivative described in the foregoing include the compounds represented by (Chem. 1) of JP-B-6-77138, specifically, compounds described at pages 3 and 4 of the publication; the compounds represented by the formula (I) of JP-B-6-93082, specifically, Compounds 1-38 described at pages 8 to 18 of the publication; the compounds represented by the formulae (4), (5) and (6) of JP-A-6-230497, specifically, Compounds 4-1 to 4-10 described at pages 25 and 26, Compounds 5-1 to 5-42 described at pages 28 to 36 and Compounds 6-1 to 6-7 described at pages 39 and 40 of the publication; the compounds represented by the formulae (1) and (2) of JP-A-6-289520, specifically, Compounds 1-1) to 1-17) and 2-1) described at pages 5 to 7 of the publication; the compounds represented by (Chem. 2) and (Chem. 3) of JP-A-6-313936, specifically, compounds described at pages 6 to 19 of the publication; the compound represented by (Chem. 1) of JP-A-6-313951, specifically, the compounds described at pages 3 to 5 of the publication; the compound represented by the formula (I) of JP-A-7-5610, specifically, Compounds I-1 to I-38 described at pages 5 to 10 of the publication; the compounds represented by the formula (II) of JP-A-7-77783, specifically, Compounds II-1 to II-102 described at pages 10 to 27 of the publication; the compounds represented by the formulae (H) and (Ha) of JP-A-7-104426, specifically, Compounds H-1 to H-44 described at pages 8 to 15 of the publication; the compounds characterized by having in the vicinity of the hydrazine group an anionic group or a nonionic group capable of forming an internal hydrogen bond with a hydrogen atom of hydrazine, described in JP-A-9-22082, particularly, the compounds represented by the formulae (A), (B), (C), (D), (E) and (F), specifically, Compounds N-1 to N-30 described in the publication; the compound represented by the formula (1) described in JP-A-9-22082, specifically, Compounds D-1 to D-55 described in the publication; various hydrazine derivatives described at pages 25 to 34 of Kochi Gijutsu (Known Techniques), pages 1 to 207, Aztech (issued on Mar. 22, 1991); and Compounds D-2 and D-39 described in JP-A-62-86354 (pages 6 and 7).

The addition amount of the hydrazine derivatives for use as a nucleation agent in the present invention is preferably from $1\times10^{-6}$ to $1\times10^{-2}$ mol, more preferably from $1\times10^{-5}$ to $5\times10^{-3}$ mol, most preferably from $2\times10^{-5}$ to $5\times10^{-3}$ mol, per mol of silver.

The hydrazine derivatives may be used after dissolving it in an appropriate organic solvent such as an alcohol (e.g., methanol, ethanol, propanol, fluorinated alcohol), a ketone (e.g., acetone, methyl ethyl ketone), dimethylformamide, dimethylsulfoxide or methyl cellosolve.

Also, the hydrazine derivatives for use in the present invention each may be dissolved by an already well-known emulsification dispersion method using an oil such as dibutyl phthalate, tricresyl phosphate, glyceryl triacetate or diethyl phthalate, or an auxiliary solvent such as ethyl acetate or cyclohexanone, and mechanically formed into an emulsified dispersion before use. Furthermore, they may be used after dispersing the powder of the hydrazine derivative in water by a method known as a solid dispersion method, using a ball mill, colloid mill or ultrasonic wave.

The hydrazine derivatives for use in the present invention may be added to any layers as far as the layer is the image forming layer or a binder layer on the image recording layer side with respect to the support, but they are preferably added to an image forming layer or a binder layer adjacent thereto.

In the present invention, an ultrahigh contrast accelerator may be used in combination with the above-described nucleation agent so as to form an ultrahigh contrast image. Examples thereof include amine compounds described in U.S. Pat. No. 5,545,505, specifically, AM-1 to AM-5; hydroxamic acids described in U.S. Pat. No. 5,545,507, specifically, HA-1 to HA-11; acrylonitriles described in U.S. Pat. No. 5,545,507, specifically, CN-1 to CN-13, hydrazine compounds described in U.S. Pat. No. 5,558,983, specifically, CA-1 to CA-6; and onium salts described in JP-A-9-297368, specifically, A-1 to A-42, B-1 to B-27 and C-1 to C-14. The synthesis methods, addition methods and addition amounts of the ultrahigh contrast accelerators may be the methods, amounts and the like according to the descriptions of the respective cited patens.

In the photothermographic material according to the present invention, it is preferable to use the above nucleation agent together with an acid created from diphosphorus pentaoxide upon hydration or its salt. As such an acid created from diphosphorus pentaoxide upon hydration or its salt, metaphosphoric acid (metaphosphate), pyrophosphoric acid (pyrophosphate), orthophosphoric acid (orthophosphate), triphosphoric acid (triphosphate), tetraphosphoric acid (tetraphosphate), hexametaphosphoric acid (hexametaphosphate), and so on are raized. Orthophosphoric acid (orthophosphate), and hexametaphosphoric acid (hexametaphosphate) are particularly preferred, and specific examples include sodium orthophosphoric acid, sodium dihydrogen orthophosphoric acid, sodium hexametaphosphoric acid, ammonium hexametaphosphoric acid, and so on.

The use amount of the acid created from the aforementioned diphosphorus pentaoxide upon hydration or its salt can be a prescribed amount according to the performance such as the sensitivity or the fog, and a preferable use amount as a coating amount per $m^2$ of photosensitive material is 0.1 to 500 $mg/m^2$, and more preferably, 0.5 to 100 $mg/m^2$.

The acid created from the aforementioned diphosphorus pentaoxide upon hydration or its salt is added to the image forming layer or a binder layer adjacent thereto because bringing desired effects even in a small amount.

In the photothermographic material according to the present invention, the image forming layer contains a binder. As a binder for this invention, polymer latexes as described below are preferably used.

The polymer species of the polymer latex used as a binder in the present invention may be of acrylic resin, vinyl acetate resin, polyester resin, polyurethane resin, rubber-based resin, vinyl chloride resin, vinylidene chloride resin, polyolefin resin or a copolymer thereof. The polymer may be a straight-chained polymer, a branched polymer or a cross-linked polymer. The polymer may be a so-called homopolymer obtained by polymerizing a single kind of monomers or may be a copolymer obtained by polymerizing two or more kinds of monomers. The copolymer may be either a random copolymer or a block copolymer. The polymer preferably has a number average molecular weight of from 5,000 to 1,000,000, more preferably on the order of from 10,000 to 100,000. If the molecular weight is too small, the image forming layer is deficient in the mechanical strength, whereas if it is excessively large, the film-forming property is disadvantageously poor.

Specific examples of the polymer include a methyl methacrylate/ethyl acrylate/methacrylic acid copolymer latex, methyl methacrylate/2-ethylhexyl acrylate/hydroxyethyl methacrylate/styrene/acrylic acid copolymer latex, styrene/butadiene/acrylic acid copolymer latex, styrene/butadiene/divinylbenzene/methacrylic acid copolymer latex, methyl methacrylate/vinyl chloride/acrylic acid copolymer latex and vinylidene chloride/ethyl acrylate/acrylonitrile/methacrylic acid copolymer latex. Such polymers are also commercially available and examples of the polymer which can be used include acrylic resins such as CEBIAN A-4635, 46583, 4601 (all produced by Dicel Kagaku Kogyo Co., Ltd), Nipol Lx811, 814, 821, 820, 857, 857×2 (all produced by Nippon Zeon Co., Ltd); polyester resins such as FINETEX ES650, 611, 675, 850 (all produced by Dai Nippon Ink & Chemicals, Inc.), WD-size and WMS (both produced by Eastman Chemical); polyurethane resins such as HYDRAN AP10, 20, 30, 40 (all produced by Dai-Nippon Ink & Chemicals, Inc.); rubber-based resins such as LACSTAR 7310K, 3307B, 4700H, 7132C (all produced by Dai-Nippon Ink & Chemicals, Inc.), Nipol Lx416, 410, 438C, 2507 (all produced by Nippon Zeon Co., Ltd.); vinyl chloride resins such as G351, G576 (both produced by Nippon Zeon Co., Ltd.); vinylidene chloride resins such as L502, L513 (both produced by Asahi Chemical Industry Co., Ltd.), ARON D7020, D504, D5071 (all produced by Mitsui Petrochemical Industries, Ltd.); and olefin resins such as CHEMIPEARL S120 and SA100 (both produced by Mitsui Petrochemical Industries, Ltd.) and the like. These polymers may be used individually or if desired, as a blend of two or more thereof.

The binder used in the image forming layer according to the present invention preferably includes the polymer latex in an amount of 50% by weight or higher of the entire binder, more preferably, 70% by weight or higher. When the image forming layer is constituted of two or more layers, at least one layer among the plurality of the image forming layers is preferably an image forming layer containing the aforementioned polymer latex at least 50% by weight or higher of the entire binders.

The polymer latex can be used not only for the image forming layer but also for the protection layer and the back layer. Particularly, when the photothermographic material of the invention is used for the printing purpose in which size deviation is concerned, it is preferable to use the polymer latex in the protection layer and the back layer. Polymer latex capable of obtaining a good photographic property as well as performing an aqueous coating is preferably used as a main binder on the image forming layer side.

"The polymer latex" herein indicates water-insoluble hydrophobic polymer as fine particles dispersed in a water-soluble dispersion medium. With respect to the dispersion state, the polymer may be emulsified in the dispersion medium, emulsion-polymerized or micell dispersed or the polymer may have a partially hydrophilic structure in the polymer molecule so that the molecular chain itself is dispersed in the molecule. The polymer latex for use in the present invention is described in Gosei Jushi Emulsion (Synthetic Resin Emulsion), compiled by Taira Okuda and Hiroshi Inagaki, issued by Kobunshi Kanko Kai (1978), Gosei Latex no Oyo (Application of Synthetic Latex), compiled by Takaaki Sugimura, Yasuo Kataoka, Souichi Suzuki and Keishi Kasahara, issued by Kobunshi Kanko Kai (1993), and Soichi Muroi, Gosei Latex no Kagaku (Chemistry of Synthetic Latex), Kobunshi Kanko Kai (1970) and the like. The dispersion particles preferably have an average particle size of from 1 to 50,000 nm, more preferably on the order of from 5 to 1,000 nm. The particle size distribution of the dispersed particles is not particularly limited, and the dispersed particles may have a broad particle size distribution or a monodisperse particle size distribution.

As the polymer latex used as a binder in the present invention, a so-called core/shell type latex may be used other than the normal polymer latex having a uniform structure. In this case, it is preferred in some cases that the core and the shell have different glass transition temperatures.

The polymer latex used as the binder in the present invention has a glass transition temperature (Tg) of which preferred range may be different among those for the protection layer, the back layer and the image forming layer. In the image forming layer, the glass transition temperature is preferably from −30° C. to 40° C., to promote the diffusion of the photographically useful materials during the heat development. When used in the protective layer and the back layer, the glass transition temperature is preferably 25° C. to 70° C. because the protection layer and the back layer are brought into contact with various instruments.

The binder in the image forming layer of the photothermographic material according to the present invention preferably includes the polymer latex, of which the glass transition temperature is in a range from −30° C. to 40° C., the polymer latex being 50% by weight or higher of the entire binder.

The polymer latex for use in the present invention preferably has a minimum film-forming temperature (MFT) of from −30 to 90° C., more preferably from 0 to 70° C. In order to control the minimum film-forming temperature, a film-forming aid may be added. The film-forming aid is also called a plasticizer and it is an organic compound (usually an organic solvent) capable of reducing the minimum film-forming temperature of the polymer latex. This organic compound is described in Souichi Muroi, Gosei Latex no Kagaku (Chemistry of Synthetic Latex), Kobunshi Kanko Kai (1970), ibid.

The image forming layer of the invention may contain a hydrophilic polymer in an amount of less than 50% by weight of the entire binder, such as gelatin, polyvinyl alcohol, methyl cellulose, hydroxypropyl cellulose, carboxymethyl cellulose and hydroxypropylmethyl cellulose. The amount of the hydrophilic polymer added is preferably 30% by weight or less of the entire binder in the image forming layer, more preferably, 15% by weight or less.

The total binder amount of the image forming layer of the invention is in a range from 0.2 to 30 g/m$^2$, more preferably from 1 to 15 m$^2$.

The image forming layer of the present invention is preferably formed by coating an aqueous coating solution and then drying it. The term "aqueous" as used herein means that 60% by weight or more of the solvent (dispersion medium) in the coating solution is composed of water. The component other than water of the coating solution may be a water-miscible organic solvent such as methyl alcohol, ethyl alcohol, isopropyl alcohol, methyl cellusolve, ethyl cellusolve, dimethylformamide, and ethyl acetate. As a specific solvent compositions, the followings can be exemplified: water/methanol=90/10, water/methanol=70/30, water/ethanol=90/10, water/isopropanol=90/10, water/dimethylformamide=95/5, water/methanol/dimethylformamide=80/15/5, water/methanol/dimethylformamide=90/5/5 (the number indicates % by weight).

The photothermographic material according to the present invention has, on an outer side of the image forming layer, that is, on a side opposite to the side having the support, a layer including:

one or more organic acid compounds represented by following Formula (1),

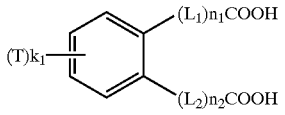

(where T represents a univalent substituent and $k_1$ represents an integer of from 0 to 4; in the case of $k_1 \geqq 2$, each of plurality of T may be the same or different one another and may be combined to form a ring; $L_1$ and $L_2$ each represents a bivalent linking group; $n_1$ and $n_2$ each independently represents an integer of from 0 to 30), and one or more compounds represented by following Formula (2), Formula (2)

$$R—(A)_n—Y$$

(where R represents an alkyl group, an alkenyl group or an aryl group which may be substituted or unsubstituted and have 6 to 30 carbon atoms; A represents a bivalent linking group; n represents an integer of from 0 to 50; Y represents —$SO_3M$ or —$OSO_3M$; M represents a hydrogen atom, an alkali metal atom, an alkaline-earth metal atom, an ammonium group or a lower alkylamine).

Containing this layer can provide such a photothermographic material as having a high Dmax (maximum density), a low fog, and less surface defects such as repellency, coating lines or the like.

Examples of the univalent substituent represented by T include an alkyl group (having a carbon atom number preferably from 1 to 20, more preferably from 1 to 12, especially preferably from 1 to 8, for example, methyl, ethyl, n-propyl, iso-propyl, n-butyl, iso-butyl, tert-butyl, n-octyl, n-decyl, n-hexadecyl, cyclopropyl, cyclopentyl, cyclohexyl and the like), an alkyl group (having a carbon atom number preferably from 2 to 20, more preferably from 2 to 12, and especially preferably from 2to 8, for example vinyl, allyl, 2-butenyl, 3-pentenyl and the like), an alkynyl group (having a carbon atom number preferably from 2 to 20, more preferably from 2 to 12, and especially preferably from 2 to 8, for example, propargyl, 3-bentynyl and the like), an aryl group (having a carbon atom number preferably from 6 to 30, more preferably from 6 to 20, and especially preferably from 6 to 12, for example, phenyl, p-methylphenyl, naphthyl and the like), an amino group (having a carbon atom number preferably from 0 to 20, more preferably from 0 to 10, and especially preferably from 0 to 6, for example, amino, methylamino, dimethylamino, diethylamino, dibenzyl amino and the like), an alkoxy group (having a carbon atom number preferably from 1 to 20, more preferably from 1 to 12, and especially preferably from 1 to 8, for example, methoxy, ethoxy, isopropoxy, butoxy and the like), an aryloxy group (having a carbon atom number preferably from 6 to 20, more preferably from 6 to 16, and especially preferably from 6 to 12, for example, phenyloxy, 2-naphthyloxy and the like), an acyl group (having a carbon atom number preferably from 1 to 20, more preferably from 1 to 16, and especially preferably from 1 to 12, for example, acetyl, benzoyl, formyl, pivaroyl and the like), an alkoxycarbonyl group (having a carbon atom number preferably from 2 to 20, more preferably from 2 to 16, and especially preferably from 2 to 12, for example, methoxycarbonyl, ethoxycarbonyl, tetradecyloxycarbonyl and the like), an aryloxycarbonyl group (having a carbon atom number preferably from 7 to 20, more preferably from 7 to 16 and especially preferably from 7 to 10, for example, phenyloxycarbonyl and the like), an acyloxy group (having a carbon atom number preferably from 2 to 20, more preferably from 2 to 16 and especially preferably from 2 to 10, for example, acetoxy, benzoyloxy and the like), an acylamino group (having a carbon atom number preferably from 2 to 20, more preferably from 2 to 16, and especially preferably from 2 to 10, for example, acetylamino, propionylamino, benzoylamino and the like), an alkoxycarbonylamino group (having a carbon atom number preferably from 2 to 20, more preferably from 2 to 16, and especially preferably from 2 to 12, for example, methoxycarbonyl amino and the like), an aryloxycarbonylamino group (having a carbon atom number preferably from 7 to 20, more preferably from 7 to 16, and especially preferably from 7 to 12, for example, phenyloxycarbonylamino and the like), a sulfonylamino group (having a carbon atom number preferably from 1 to 20, more preferably from 1 to 16 and especially preferably from 1 to 12, for example, methansulfonylamino, octanesulfonylamino, benzensulfonylamino and the like), a sulfamoyl group (having a carbon atom number preferably from 0 to 20, more preferably from 0 to 16, and especially preferably from 0 to 12, for example, sulfamoyl, methylsulfamoyl, dimethylsulfamoyl, phenylsulfamoyl and the like), a carbamoyl group (having a carbon atom number preferably from 1 to 20, more preferably from 1 to 16, and especially preferably from 1 to 12, for example, carbamoyl, methylcarbamoyl, diethylcarbamoyl, phenylcarbamoyl and the like), an alkylthio group (having a carbon atom number preferably from 1 to 20, more preferably from 1 to 16, and especially preferably from 1 to 12, for example, methylthio, ethylthio and the like), an arylthio group (having a carbon atom number preferably from 6 to 20, more preferably from 6 to 16 and especially preferably from 6 to 12, for example, phenylthio and the like), a sulfonyl group (having a carbon atom number preferably from 1 to 20, more preferably from 1 to 16 and especially preferably 1 to 12, for example, mesyl, tosyl and the like), a sulfinyl group (having a carbon atom number preferably from 1 to 20, more preferably from 1 to 16, and especially preferably from 1 to 12, for example, methanesulfinyl, benzensulfinyl and the like), an ureido group (having a carbon atom number preferably from 1 to 20, more preferably from 1 to 16, and especially preferably from 1 to 12, for example, ureido, methylureido, phenylureido and the like), a phosphoric acid amido group (having a carbon atom number preferably from 1 to 20, more preferably from 1 to 16 and especially preferably from 1 to 12, for example, diethylphosphoric acid amido, phenylphosphoric acid amido and the like), a hydroxyl group, a carboxyl group, a sulfo group, sulfino group (sulfinic acid group), a mercapto group, a halogen atom (for example, a fluorine atom, a chlorine atom, a bromide atom, and an iodine atom), a cyano group, a nitro group, a hydroxamic acid group, a hydrazino group, a heterocyclic group (for example, imidazolyl, pyridyl, furil, piperidyl, morpholino and the like).

As for an example where a plurality of T is combined with each other to form a ring, any of known condensed-ring phthalic acids may be used, but there may be raised, as preferable examples, [3, 4]benzo, [4,5]benzo, [4,5]naphtho, [3,4]methylenedioxy (that is, dioxolo), [4,5]methylenedioxy and the like. In addition, the substituent capable of forming salt such as alkali metal may form salt. These substituents or condensed rings may be further substituted. When substituents are two or more, these substituents may be the same or different.

When a plurality of T do not form ring with each other, $k_1$ is preferably 0, 1 or 2 and especially preferably 0 or 1.

The substituent represented by T is preferably an alkyl group, an alkenyl group, an aryl group, alkoxy group, an aryloxy group, an acyl group, an acyloxy group, an alkoxycarbonyl group, an acylamino group, an alkoxycarbonylamino group, an aryloxycarbonylamino group, a sulfonylamino group, a sulfamoyl group, a carbamoyl group, an ureido group, a phosphoric acid amido group, a hydroxyl group, a carboxyl group, a sulfo group, a sulfino group, a sulfonyl group, a halogen atom, a cyano group, a nitro group, a hetero cyclic group, [3, 4]benzo, [4,5]benzo, [4,5] naphtho, [3,4]methylenedioxy, or [4,5]methylenedioxy, and further preferably an alkyl group, an aryl group, an alkoxy group, an aryloxy group, an acyl group, an acylamino group, a sulfonylamino group, a sulfamoyl group, a carbamoyl group, a hydroxyl group, a sulfonyl group, a halogen atom, a cyano group, [3,4]benzo, [4,5]benzo, [3,4] methylenedioxy, or [4,5]methylenedioxy, and especially preferably an alkyl group, an aryl group, an alkoxy group, [4,5]benzo or [4,5]methylenedioxy.

$L_1$ and $L_2$ each represents a bivalent linking group, which is preferably a bivalent linking group where the linking chain is constituted by 1 to 4 atoms, and may further contain a substituent. Preferable examples are —$CH_2$—, —$CH_2CH_2$—, —C(=O)—, —CONH—, and —$SO_2NH$—.

$n_1$ and $n_2$ each independently represents an integer of from 0 to 30.

As for a favorable combination of $L_1$, $L_2$, $n_1$, and $n_2$, when $L_1$ and $L_2$ each represents a linking group having a length that is the same as that of from 0 to 2 atoms, $n_1$ and $n_2$ each is 0 to 10, further preferably 0 to 6; when $L_1$ and $L_2$ each represents a linking group having a length that is the same as that of from 3 to 4 atoms, $n_1$ and $n_2$ each is 0 to 6. As for a further preferable combination, $L_1$ and $L_2$ each represents —$CH_2$—, —$CH_2CH_2$—, —C(=O)—, —CONH—, or —$SO_2NH$— and $n_1$ and $n_2$ each represents 0 to 2.

The organic acid compound represented by Formula (1) may be synthesized according to methods in Shin Jikken Kagaku Kouza (New Experimental Chemical Lecture) (Maruzen Co., Ltd.) 14-III, Chapter 5-1, Organic Fanctional Group Preparations (Academic Press New York and London) I-Chapter 9, Tetrahedron, Vol. 31 (20), pp. 2607–2619 (1975), Angewante Chem. Vol 86 (9), p. 349 (1974) and documents cited from these mentioned above. Commercially available compounds may also be used.

Hereinafter, favorable examples of the organic acid compounds represented by Formula (1) are raised, but the present invention is by no means limited thereto.

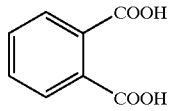

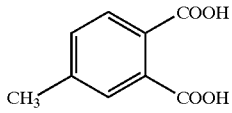

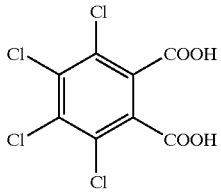

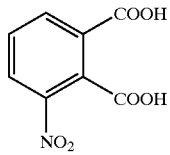

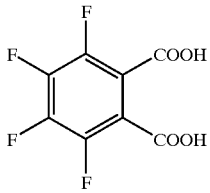

-continued

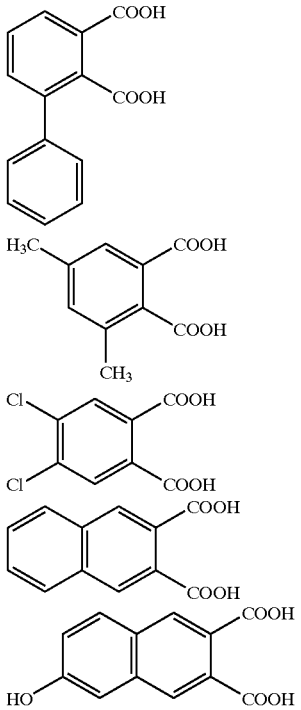

An addition amount of the organic acid compound represented by Formula (1) is preferably from $10^{-4}$ mol to 10 mol, and more preferably from $10^{-3}$mol to 1 mol per one mol of silver. In addition, the organic acid compound represented by Formula (1) may be used alone or two or more kinds of the organ ic acid compounds may be used in combination.

The organic acid compound represented by Formula (1) may be added in any form of a solution, powder, solid fine particle dispersion and the like. The solid fine particle dispersion is performed using a known pulverization means (e.g., ball mill, vibrating ball mill, sand mill, colloid mill, jet mill, roller mill). At the time of solid fine particle dispersion, a dispersing agent may also be used.

A layer to which the organic acid compound represented by Formula (1) is added is a layer (a layer on a side opposite to the side having the support in terms of an image forming layer) formed on an outer side of the image forming layer of the photothermographic material. More specifically, it may be a surface protective layer or an intermediate layer between the image forming layer and the surface protective layer, and it may also be used in the form of an overcoat over the surface protective layer.

Next, compounds represented by Formula (2) will be described in detail.

R represents an alkyl group, an alkenyl group or an aryl group which may be substituted or unsubstituted and have 6 to 30 carbon atoms. Examples of substituted or unsubstituted alkyl groups having a carbon atom number of 6 to 30 include hexyl, cyclohexyl, heptyl, octyl, 2-ethylhexyl, nonyl, isononyl, decyl, isodecyl, dodecyl, tetradecyl, hexadecyl, octadecyl, eicocyl, dococyl, triacontacyl, perfluorohexyl, perfluoroheptyl, perfluorooctyl, perfluorononyl, perfluorodecyl, perfluorododecyl, perfluorohexadecyl and the like.

Examples of an alkenyl group having a carbon atom number of 6 to 30 include 3-hexenyl, 11-dodecenyl, oleyl, erucacyl, perfluoroisohexenyl, perfluoroisonotenyl, and perfluorododecenyl.

As an aryl group, preferable is phenyl, naphthyl, substituted phenyl or substituted naphthyl, and as a substituent, preferable is a (mono, di, tri, tetra) alkyl group (for example, methyl, ethyl, propyl, isopropyl, butyl, isobutyl, t-butyl, pentyl, isopentyl, t-pentyl, hexyl, isohexyl, octyl, isooctyl, nonyl, isononyl, t-nonyl, dodecyl, tetradecyl, hexadecyl, octadecyl and the like), a halogen group (chloro, bromo, phloro and the like), a substituted or unsubstituted alkyloxy group, an alkyloxycarbonyl group, alkylcarbonyl oxy group or the like. As a substituent, such a substituent the same as the aforementioned substituent is used.

A is not particularly limited as far as A is a bivalent linking group, but is preferably an alkylene group, an arylene group, or an aralkylene group which may be substituted or unsubstituted, and more preferably $(CH_2)1$, $(CH_2CH_2O)m$, $(CH(CH_3)CH_2)p$, $(CH_2CH(OH)CH_2)q$, phenylene, naphthylene, xylelene, O, COO, CON ($R^{11}$), SO, $SO_2$, or $SO_2N(R^{12})$. Here, $R^{11}$ and $R^{12}$ represent a hydrogen atom, a substituted or unsubstitutedalkyl group (for example, methyl, ethyl, propyl, butyl, hydroxyethyl, hydroxypropyl, butyl, pentyl, occyl, nonyl, decyl, dodecyl, hexadecyl, octadecyl or the like) having a carbon atom number of from 1 to 20, and an alkenyl group (ethylene, aryl, chrotyl and the like), and 1, m, p, and q each represents an integer of from 0 to 20.

n represents an integer of from 0 to 50.

Y represents —$SO_3M$ or —$OSO_3M$.

M represents a hydrogen atom, an alkali metal atom, an alkaline-earth metal atom, an ammonium group or a lower alkylamine group, and it represents more preferably a hydrogen atom, an alkali metal atom (Li, K, Na, Rb), an alkaline-earth metal atom (Be, Mg, Ca, Sr, Zn, Ba) an ammonium group or a.(mono-, di-, or tri-) lower alkyl (for example, methyl, ethyl, propyl, hydroxyethyl, hydroxypropyl or the like) amihe group having a carbon atom number of from 1 to 10.

A preferable example of the compounds represented by Formula (2) will be raised here in after, but the present invention is not limited thereto.

K-1

$C_{10}H_{21}OSO_3K$

K-2

$C_{12}H_{25}OSO_3Na$

K-3

$C_{16}H_{33}OSO_3Na$

K-4

$C_{18}H_{35}OSO_3Na$

K-5

$C_{16}H_{33}O-(CH_2CH_2O)_3-SO_3Na$

K-6

$C_{18}H_{35}O-(CH_2CH_2O)_6-SO_3K$

K-7

$C_{12}H_{25}O-(CH_2CH_2O)_3-(CH_2CH_2O)_3-(CH_2)_4-SO_3Na$ ($CH_3$)

K-8

$C_{22}H_{45}O-(CH_2CHCH_2O)_7-(CH_2)_3-SO_3K$ (OH)

K-9

$C_{18}H_{35}O-(CH_2CH_2O)_3-SO_3Li$

K-10

$C_{22}H_{45}O-(CH_2CH_2O)_6-(CH_2)_4-SO_3NH_4$

K-11

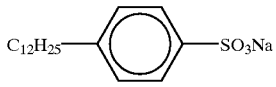

-continued

K-12

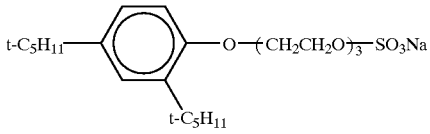

K-13

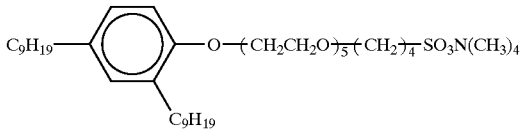

K-14

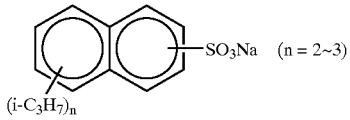

K-15

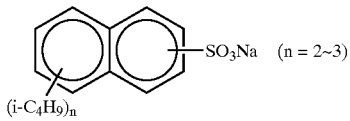

K-16

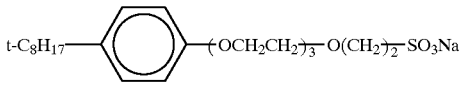

K-17

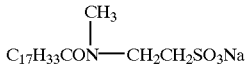

K-18

$C_{11}H_{23}CONHCH_2CH_2SO_3Li$

K-19

$C_7H_{15}CONHCH_2CH_2SO_3Na$

K-20

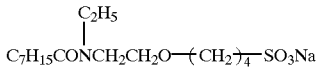

K-21

$C_8F_{17}SO_3Li$

K-22

$C_8F_{17}SO_3{\cdot}N(CH_2CH_2OH)_4$

K-23

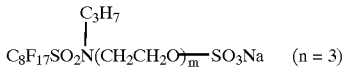

K-24

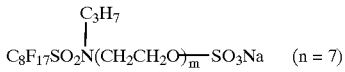

K-25

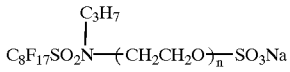

K-26

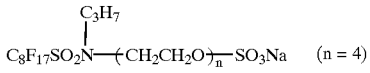

K-27

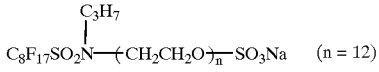

K-28

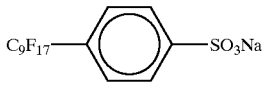

-continued

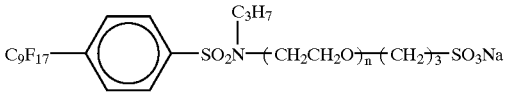

K-30

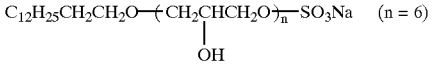

K-31

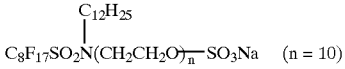

K-32

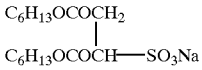

K-33

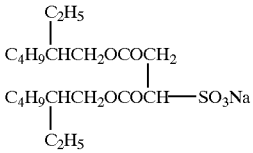

K-34

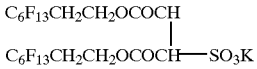

K-35

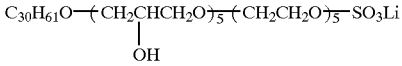

K-36

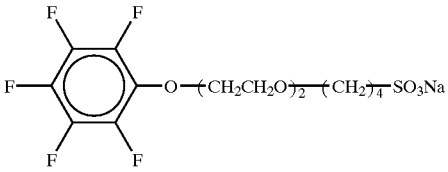

K-37

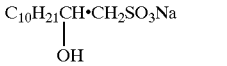

The use amount of the compound represented by Formula (2) is preferably from 0.0001 to 1 g, more preferably from 0.0002 to 0.25g, and still more preferably from 0.0003 to 0.1 g, per 1 $m^2$ of the photothermographic material. In addition, one kind of the compound represented by Formula (3) may be used or two or more kinds of the compounds may also be used in combination.

A layer to which the compound represented by Formula (2) is added is a layer formed on an outer side of the image forming layer (a layer on a side opposite to the side having the support in terms of an image forming layer) of the photothermographic material, and is the layer the same as that to which the organic acid compound represented by Formula (1) is added. More specifically, it may be a surface protective layer or an intermediate layer between the image forming layer and the surface protective layer, and it may also be used in the form of an overcoat over the surface protective layer.

The pH of the surface of the outmost layer on the image forming layer side in the photothermographic material according to the invention is preferably 6 or less to reduce fog during preservation, more preferably 5.5 or less, and further more preferably, 5.3 or less. There is no particular lower limitation but it may be around 3.

To measure the pH of the surface of the outmost layer on the image forming layerside, the photothermographic material before heat development processing is folded into a boat shape in 2.5 cm×2.5 cm; a distilled water of 300 $\mu$l is dropped on a side of the image forming layer. After calmly placed for 30 minutes, the dropped liquid is preferably measured for one minute with pH BOY-P2 (made by Shin Dengen Kogyo K.K., pH measurer of a semiconductor system).

Controlling of the outmost layer surface on the image forming layer side preferably uses an organic acid compound, a non-volatile acid such as a sulfuric acid, and a volatile base such as an ammonia. Particularly, since ammonia is ready to be volatile and can be eliminated before the coating step or before thermally heated, ammonia is preferable to reduce the pH.

The heat image forming material of the present invention contains a reducing agent for non-photosensitive silver salt. The reducing agent for the non-photosensitive silver salt may be any substance, preferably an organic substance, which reduces the silver ion to metal silver. Conventional photographic developers such as phenidone, hydroquinone and catechol are useful, but a hindered phenol reducing agent is preferred. The reducing agent may also be a so-called precursor which is devised to effectively exhibit the function only at the time of development.

For the photothermographic material using a non-photosensitive silver salt, reducing agents over a wide range are known and these are disclosed in JP-A-46-6074, JP-A-47-1238, JP-A-47-33621, JP-A-49-46427, JP-A-49-115540, JP-A-50-14334, JP-A-50-36110, JP-A-50-147711, JP-A-51-32632, JP-A-51-1023721, JP-A-51-32324, JP-A-51-51933, JP-A-52-84727, JP-A-55-108654, JP-A-56-146133, JP-A-57-82828, JP-A-57-82829, JP-A-6-3793, U.S. Pat. Nos. 3,679,426, 3,751,252, 3,751,255, 3,761,270, 3,782,949, 3,839,048, 3,928, 686 and 5,464,738, German Patent No. 2,321,328, European Patent 692732 and the like.

Examples thereof include amidoximes such as phenylamidoxime, 2-thienylamidoxime and p-phenoxyphenylamidoxime; azines such as 4-hydroxy-3,5-dimethoxybenzaldehyde azine; combinations of an aliphatic carboxylic acid arylhydrazide with an ascorbic acid such as a combination of 2,2-bis(hydroxymethyl)propionyl-β-phenylhydrazine with an ascorbic acid; combinations of polyhydroxybenzene with hydroxylamine, reductone and/or hydrazine such as a combination of hydroquinone with bis(ethoxyethyl)hydroxylamine, piperidinohexose reductone or formyl-4-methylphenylhydrazine; hydroxamic acids such as phenylhydroxamic acid, p-hydroxyphenylhydroxamic acid and β-anilinehydroxamic acid; combinations of an azine with a sulfonamidophenol such as a combination of phenothiazine with 2,6-dichloro-4-benzenesulfonamidophenol; α-cyanophenylacetic acid derivatives such as ethyl-α-cyano-2-methylphenylacetate and ethyl-α-cyanophenylacetate; bis-β-naphthols such as 2,2'-dihydroxy-1,1'-binaphthyl, 6,6'-dibromo-2,2'-dihydroxy-1,1'-binaphthyl and bis(2-hydroxy-1-naphthyl) methane; combinations of a bis-β-naphthol with a 1,3-dihydroxybenzene derivative (e.g., 2',4'-dihydroxybenzophenone, 2,4-dihydroxyacetophenone); 5-pyrazolones such as 3-methyl-1-phenyl-5-pyrazolone; reductones such as dimethylaminohexose reductone, anhydrodihydroaminohexose reductone and anhydrodihydropiperidonehexose reductone; sulfonamidophenol reducing agents such as 2,6-dichloro-4-benzenesulfonamidophenol and p-benzenesulfonamidophenol; 2-phenylindane-1,3-diones; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methylphenyl) propane, 4,4-ethylidene-bis(2-t-butyl-6-methylphenol), 1,1-bis(2-hydroxy-3,5-dimethylphenyl)-3,5,5-trimethylhexane and 2,2-bis(3,5-dimethyl-4-hydroxyphenyl)propane; ascorbic acid derivatives such as 1-ascorbyl palmitate and ascorbyl stearate; aldehydes and ketones such as benzyl and biacetyl; 3-pyrazolidone and a certain kind of indane-1,3-diones; and chromanols such as tocopherol. Particularly preferred reducing agents are bisphenols and chromanols.

An addition amount of the reducing agent is preferably from 5 to 50% by mol, more preferably from 10 to 40% by mol, per mol of silver on the surface having an image forming layer. The layer to which the reducing agent is added may be any layer on the surface having an image forming layer. In the case of adding the reducing agent to a layer other than the image forming layer, the reducing agent is preferably used in a slightly large amount of from 10 to 50% by mol per mol of silver.

The reducing agent maybe added in any form of a solution, powder and a solid fine particle dispersion. The solid fine particle dispersion is performed using a known pulverizing means (e.g., ball mill, vibrating ball mill, sand mill, colloid mill, jet mill, roller mill). At the time of solid fine particle dispersion, a dispersing agent may also be used.

An additive known as a "color toner" capable of improving the image may be added to the heat image forming material according to the present invention. When the color toner is added, the optical density increases in some cases, and also, the color toner is advantageous in forming a black silver image depending on the case.

For the photothermographic material using a non-photosensitive silver salt, color toners over a wide range are known and these are disclosed in JP-A-46-6077, JP-A-47-10282, JP-A-49-5019, JP-A-49-5020, JP-A-49-91215, JP-A-49-91215, JP-A-50-2524, JP-A-50-32927, JP-A-50-67132, JP-A-50-67641, JP-A-50-114217, JP-A-51-3223, JP-A-51-27923, JP-A-52-14788, JP-A-52-99813, JP-A-53-1020, JP-A-53-76020, JP-A-54-156524, JP-A-54-156525, JP-A-61-183642, JP-A-4-56848, JP-B-49-10727, JP-B-54-20333, U.S. Pat. Nos. 3,080,254, 3,446,648, 3,782,941, 4,123,282 and 4,510,236, British Patent No. 1,380,795 and Belgian Patent No. 841910.

Examples of the color toner include phthalimide and N-hydroxyphthalimide; succinimide, pyrazolin-5-ones and cyclic imides such as quinazolinone, 3-phenyl-2-pyrazolin-5-one, 1-phenylurazole, quinazoline and 2,4-thiazolidinedione; naphthalimides (e.g., N-hydroxy-1,8-naphthalimide); cobalt complexes (e.g., cobalt hexaminetrifluoroacetate); mercaptanes such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboxyimides (e.g., N,N-(dimethylaminomethyl)phthalimide and N,N'-(dimethylaminomethyl)naphthalene-2,3-dicarboxyimide); blocked pyrazoles, isothiuronium derivatives and a certain kind of photobleaching agents (e.g., N,N'-hexamethylenebis(1-carbamoyl-3,5-dimethylpyrazole), 1,8-(3,6-diazaoctane) bis(isothiuroniumtrifluoroacetate) and 2-(tribromomethylsulfonyl)-(benzothiazole)); 3-ethyl-5-[(3-ethyl-2-benzothiazolinylidene)-1-methylethylidene]-2-thio-2,4-oxazolidinedione; phthalazinone, phthalazinone derivatives and metal salts thereof, or derivatives such as 4-(1-naphthyl)phthalazinone, 6-chlorophthalazinone, 5,7-dimethyloxyphthalazinone and 2,3-dihydro-1,4-phthalazinedione; combinations of phthalazinone with aphthalic acid derivative (e.g., the derivatives such as phthalic acid, 4-methylphthalic acid, 4-nitrophthalic acid, tetrachlorophthalic acid anhydride) and metal salts thereof;

phthalazine, phthalazine derivatives (e.g., 4-(1-naphthyl) phthalazine, 6-chlorophthalazinone, 5,7-dimethoxyphthalazine, 6-iso-butylphthalazine, 6-tert-butylphthalazine, 5,7-dimethylphthalazine, and 2,3-dihydrophthalazine) and metal salts thereof; combinations of a phthalazine and phthalazine derivative with a phthalic acid derivative (e.g., phthalic acid, 4-methylphthalic acid, 4-nitrophthalic acid, tetrachlorophthalic acid anhydride), quinazolinedione, benzoxazine and naphthoxazine derivatives; rhodium complexes which function not only as a color toner but also as a halide ion source for the formation of silver halide at the site, such as ammonium hexachlororhodate (III), rhodium bromide, rhodium nitrate and potassium hexachlororhodate (III); inorganic peroxides and persulfates such as ammonium disulfide peroxide and hydrogen peroxide; benzoxazine-2,4-diones such as 1,3-benzoxazin-2,4-dione, 8-methyl-1,3-benzoxazin-2,4-dione, and 6-nitro-1,3-benzoxazin-2,4-dione; pyrimidines and asymmetric triazines (e.g., 2,4-dihydroxpyrimidine and 2-hydroxy-4-aminopyrimidine) and azauracil and tetraazapentalene derivatives (e.g., 3,6-dimercapto-1,4-diphenyl-1H,4H-2,3a,5,6a-tetraazapentalene and 1,4-di(o-chlorophenyl)-3,6-dimercapto-1H,4H-2,3a,5,6a-tetraazapentalene).

The color toner may be a so-called precursor which is devised to effectively exhibit the function only at the time of development.

The color toner is preferably contained on the surface having an image forming layer in an amount of from 0.1 to 50% by mol, more preferably from 0.5 to 20% by mol, per mol of silver.

The color toner may be added in any form of a solution, powder and a solid fine particle dispersion. The solid fine particle dispersion is performed using a known pulverizing means (e.g., ball mill, vibrating ball mill, sand mill, colloid mill, jet mill, roller mill). At the time of solid fine particle dispersion, a dispersing agent may also be used.

The photothermographic material of the present invention may contain a sensitizing dye. The sensitizing dye may be any one of those that can spectrally sensitize the halogenated silver halide particles at a desired wavelength region when they are adsorbed on the halogenated silver halide particles. As such sensitizing dyes, usable are, for example, cyanine dyes, merocyanine dyes, complex cyaninedyes, complexmerocyaninedyes, holopolarcyaninedyes, styryl dyes, hemicyanine dyes, oxonole dyes and hemioxonole dyes. Sensitizing dyes which are usable in the present invention are described, for example, in Research Disclosure, Item 17643, IV-A (December, 1978, page 23), Item 1831X (August, 1978, page 437) and also in the references as referred to in them. In particular, sensitizing dyes having a color sensitivity suitable for spectral characteristics of light sources of various laser imagers, scanners, image setters, process cameras and the like can advantageously be selected.

Exemplary dyes for spectral sensitization to so-called red light from light sources such as He-Ne laser, red semiconductor laser, and LED include Compounds I-1 to I-38 disclosed in JP-A-54-18726, Compounds I-1 to I-35 disclosed in JP-A-6-75322, Compounds I-1 to I-34 disclosed in JP-A-7-287338, Dyes 1 to 20 disclosed in JP-B-55-39818, Compounds I-1 to I-37 disclosed in JP-A-62-284343, and Compounds I-1 to I-34 disclosed in JP-A-7-287338, which are selected advantageously.

Spectral sensitization as to the wavelength region of from 750 to 1,400 nm from semiconductor laser light sources can advantageously be obtained with various known dyes such as a cyanine dye, a merocyanine dye, a styryl dye, a hemicyanine dye, an oxonol dye, a hemioxonol dye and a xanthene dye. Useful cyanine dyes are cyanine dyes having a basic nucleus such as thiazoline nucleus, oxazoline nucleus, pyrroline nucleus, pyridine nucleus, oxazole nucleus, thiazole nucleus, selenazole nucleus or imidazole nucleus. Useful merocyanine dyes are merocyanine dyes having the above-described basic nucleus or an acidic nucleus such as thiohydantoin nucleus, rhodanine nucleus, oxazolidinedione nucleus, thiazolinedione nucleus, barbituric acid nucleus, thiazolinone nucleus, malononitrile nucleus or pyrazolone nucleus. Of these cyanine and merocyanine dyes, those having an imino group or a carboxyl group are particularly effective. The dye may be appropriately selected from known dyes described, for example, in U.S. Pat. Nos. 3,761,279, 3,719,495 and 3,877,943, British Patent Nos. 1,466,201, 1,469,117and 1,422,057, JP-B-3-10391, JP-B-6-52387, JP-A-5-341432, JP-A-6-194781 and JP-A-6-301141.

The dyes particularly preferably used for the present invention are cyanine dyes having a substituent containing a thioether bond (e.g., dyes described in JP-A-62-58239, JP-A-3-138638, JP-A-3-138642, JP-A-4-255840, JP-A-5-72659, JP-A-5-72661, JP-A-6-222491, JP-A-2-230506, JP-A-6-258757, JP-A-6-317868, JP-A-6-324425, JP-W-A-7-500926 (the code "JP-W-A" as used herein means an "international application published in Japanese for Japanese national phase"), and U.S. Pat. No. 5,541,054), dyes having a carboxylic acid group (e.g., dyes disclosed in JP-A-3-163440, JP-A-6-301141, and U.S. Pat. No. 5,441,899), merocyanine dyes, polynuclear merocyanine dyes and polynuclear cyanine dyes (dyes disclosed in JP-A-47-6329, JP-A-49-105524, JP-A-51-127719, JP-A-52-80829, JP-A-54-61517, JP-A-59-214846, JP-A-60-6750, JP-A-63-159841, JP-A-6-35109, JP-A-6-59381, JP-A-7-146537, JP-A-7-146537, JP-A-W-55-50111, British Patent No. 1,467,638, and U.S. Pat. No. 5,281,515) and the like.

Dyes forming J-band have been disclosed in U.S. Pat. Nos. 5,510,236, 3,871,887 (Example 5), JP-A-2-96131, JP-A-59-48753 and the like, and they can preferably be used for the present invention.

These sensitizing dyes may be used either individually or in combination of two or more thereof. The combination of sensitizing dyes is often used for the purpose of supersensitization. In combination with the sensitizing dye, a dye which itself has no spectral sensitization effect or a material which absorbs substantially no visible light, but which exhibits supersensitization may be incorporated into the emulsion. Useful sensitizing dyes, combinations of dyes which exhibit supersensitization, and materials which show supersensitization are described in *Research Disclosure*, Vol. 176, 17643, page 23, Item IV-J (December, 1978), JP-B-49-25500, JP-B-43-4933, JP-A-59-19032, JP-A-59-192242 and the like.

The amount of the sensitizing dye used in the present invention may be selected according to the performance such as sensitivity or fog; however, it is preferably from $10^{-6}$ to 1 mol, more preferably from $10^{-4}$ to $10^{-1}$ mol, per mol of silver halide in the photosensitive layer.

The sensitizing dye is preferably added to the photosensitive silver halide emulsion, and the sensitizing dye may be added by, as adding methods, dispersing it directly in the emulsion or may be added to the emulsion after dissolving it in a solvent such as water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol and N,N-dimethylformamide, and the solvent may be a sole solvent or a mixed solvent. Furthermore, the sensitizing dye may be added using a method disclosed in U.S. Pat. No. 3,469,987 where a dye is dissolved in a volatile organic solvent, the solution is dispersed in water or hydrophilic colloid, and the dispersion is added to an emulsion, a method disclosed in JP-B-44-23389, JP-B-44-27555 and JP-B-57-22091 where a dye is dissolved in an acid and the solution is added to an emulsion or the solution is formed into an aqueous solution while allowing the presence together of an acid or base and then added to an emulsion, a method disclosed in U.S. Pat. Nos. 3,822,135 and 4,006,025 where an aqueous solution or colloid dispersion of a dye is formed in the presence of a surface active agent and the solution or dispersion is added to an emulsion, a method disclosed in JP-A-53-102733 and JP-A-58-105141 where a dye is dissolved directly in hydrophilic colloid and the dispersion is added to an emulsion, or a method disclosed in JP-A-51-74624 where a dye is dissolved using a compound capable of red shifting and the solution is added to an emulsion. An ultrasonic wave may also be used in dissolving the dye.

The sensitizing dye for use in the present invention may be added to a silver halide emulsion for use in the present invention in any step heretofore known to be useful in the preparation of an emulsion. The sensitizing dye may be added in any time period or step before the coating of the emulsion, for example, in the grain formation process of silver halide and/or before desalting or during the desalting process and/or the time period from desalting until initiation of chemical ripening, as disclosed in U.S. Pat. Nos. 2,735,766, 3,628,960, 4,183,756 and 4,225,666, JP-A-58-184142 and JP-A-60-196749, or immediately before or during the chemical ripening process or in the time period after chemical ripening until coating, as disclosed in JP-A-58-113920. Furthermore, as disclosed in U.S. Pat. No. 4,225,666 and JP-A-58-7629, the same compound by itself may be added in parts or a compound in combination with another compound having a different structure may be added in parts, for example, one part is added during grain formation and another part is added during or after chemical ripening, or one part is added before or during chemical ripening and another part is added after completion of the chemical ripening, and when the compound is added in parts, the combination of the compound added in parts with another compound may also be changed.

The silver halide emulsion and/or non-photosensitive silver salt for use in the present invention can be further prevented from the production of additional fog or stabilized against the reduction in sensitivity during the stock storage, by an antifoggant, a stabilizer or a stabilizer precursor. Examples of antifoggants, stabilizers and stabilizer precursors which can be appropriately used individually or in combination include thiazonium salts described in U.S. Pat. Nos. 2,131,038 and 2,694,716, azaindenes described in U.S. Pat. Nos. 2,886,437 and 2,444,605, mercury salts described in U.S. Pat. No. 2,728,663, urazoles described in U.S. Pat. No. 3,287,135, sulfocatechol described in U.S. Pat. No. 3,235,652, oximes, nitrons and nitroindazoles described in British Patent No. 623,448, polyvalent metal salts described in U.S. Pat. No. 2,839,405, thiuronium salts described in U.S. Pat. No. 3,220,839, palladium, platinum and gold salts described in U.S. Pat. Nos. 2,566,263 and 2,597,915, halogen-substituted organic compounds described in U.S. Pat. Nos. 4,108,665 and 4,442,202, triazines described in U.S. Pat. Nos. 4,128,557, 4,137,079, 4,138,365 and 4,459,350, and phosphorus compounds described in U.S. Pat. 4,411,985.

The antifoggant which is preferably used in the present invention is an organic polyhalogen, and examples thereof include the compounds described in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809 and U.S. Pat. Nos. 5,340,712, 5,369,000 and 5,464,737, and a compound represented by Formula (P) and the exemplified compounds (P-1) to (P-118) described in JP-A-11-87972.

Formalin scavenger is effective as another antifoggant which is preferably used in the present invention; for example, a compound represented by S and its exemplified compounds (S-1) to (S-24) described in JP-A-11-23995 can be raised.

The antifoggant for use in the present invention may be added in any form of a solution, powder, solid fine particle dispersion materials and the like. The solid fine particle dispersion is performed using a known pulverization means (e.g., ballmill, vibrating ball mill, sand mill, colloid mill, jet mill, roller mill). At the time of solid fine particle dispersion, a dispersing agent may also be used.

Although not necessary for practicing the present invention, it is advantageous in some cases to add a mercury (II) salt as an antifoggant to the image-forming layer. Preferred mercury(II) salts for this purpose are mercury acetate and mercury bromide. The addition amount of mercury(II) salts for use in the present invention is preferably from $1\times10^{-9}$ mol to $1\times10^{-3}$ mol, more preferably from $1\times10^{-8}$ mol to $1\times10^{-4}$ mol, per mol of silver coated.

The photothermographic material of the present invention may contain a benzoic acid compound for the purpose of achieving high sensitivity or preventing fog. The benzoic acid compound for use in the present invention may be any benzoic acid derivative, but preferred examples of the structure include the compounds described in U.S. Pat. Nos. 4,784,939 and 4,152,160 and JP-A-8-151242, 8-151241, 8-98051 and the like. The benzoic acid compound for use in the present invention may be added to any site of the photosensitive material, but the layer to which the benzoic acid is added is preferably a layer on the surface having the image forming layer, more preferably a non-photosensitive silver salt-containing layer. The benzoic acid compound for use in the present invention may be added at any step during the preparation of the coating solution. In the case of adding the benzoic acid compound to a non-photosensitive silver salt-containing layer, it may be added at any step from the preparation of the non-photosensitive silver salt until the preparation of the coating solution, but is preferably added in the period after the preparation of the non-photosensitive silver salt and immediately before the coating. The benzoic acid compound for use in the present invention may be added in any form of a powder, solution, fine particle dispersion and the like, or may be added as a solution containing a mixture of the benzoic acid compound with other additives such as a sensitizing dye, a reducing agent and a color toner. The benzoic acid compound for use in the present invention may be added in any amount; however, the addition amount thereof is preferably from $1\times10^{-6}$ mol or higher to 2 mol or less, and more preferably from $1\times10^{-3}$ mol or higher to 0.5 mol or less, per mol of silver.

The photothermographic material of the present invention may contain a mercapto compound, a disulfide compound or a thione compound so as to control the development by inhibiting or accelerating the development, improve the spectral sensitization efficiency or improve the storage stability before or after the development.

In the case of using a mercapto compound in the present invention, any structure may be used but those represented by Ar—SM or Ar—S—S—Ar are preferred, wherein M is a hydrogen atom or an alkali metal atom, and Ar is an aromatic ring or condensed aromatic ring containing one or more nitrogen, sulfur, oxygen, selenium or tellurium atoms, preferably a heteroaromatic ring such as benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline and quinazolinone. The heteroaromatic ring may have a substituent selected from, for example, the group consisting of halogen (e.g., Br, Cl), hydroxy, amino, carboxy, alkyl (e.g., alkyl having one or more carbon atoms, preferably from 1 to 4 carbon atoms), and alkoxy (e.g., alkoxy having one or more carbon atoms, preferably from 1 to 4 carbon atoms). Examples of the mercapto substituted heteroaromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis-benzothiazole, 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 1-phenyl-5-mercaptotetrazole, 3-(5-mercaptotetrazole)-sodium benzenesulfonic acid, N-methyl-N'-[3-(5-mercaptotetrazolil)phenyl]urea, 2-mercapto-4-phenyloxazole, N-[3-(5-mercaptoacetylamino)propyl] carbazole and the like. However, the present invention is by no means limited thereto.

The addition amount of the mercapto compound is preferably from 0.0001 to 1.0 mol, more preferably from 0.001 to 0.3 mol, per mol of silver during the image formation.

The image forming layer or the adjacent layer thereto in the photothermographic material of the present invention may contain a plasticizer or lubricant, and examples thereof include polyhydric alcohols (for example, glycerins and diols described in U.S. Pat. No. 2,960,404), fatty acids or esters described in U.S. Pat. Nos. 2,588,765 and 3,121,060, and silicone resins described in British Patent No. 955,061.

As for the photothermographic material of the present invention, it is preferable to form at least one protection layer on the image forming layer.

As a binder for such a protection layer, it is preferable to use a latex of a polymer having a glass transition temperature of 25° C. or higher and 70° C. or lower as described above. In this situation, it is preferable to use the above polymer latex to form 50% by weight or higher, preferably 70% by weight or higher, of the entire binder of the protection layer. The binder structure, coating method, and the like of such a protection layer are substantially the same as those of the image forming layer. Preferably used as the binder for the protective layer are those based on acrylic compound, styrene, acrylic compound/styrene, vinyl chloride, and vinylidene chloride. Specifically, those of acrylic resin type such as VONCORT R3370, 4280, Nipol Lx857, and methyl acrylate/2-ethylhexyl (meta)acrylate/hydroxyethyl meth(meta) acrylate/styrene/(meta) acrylic acid copolymers; those of vinyl chloride resin type such as Nipol G576; and those of vinylidene chloride resin type such as Aron D5071 are preferably used.

The entire binder amount for protection layer used for the invention is 0.2 to 5.0 g/m$^2$, more preferably, 0.5 to 4.0 g/m$^2$. The binder structure and the application method of the protection layer are the same as those for the image forming layer.

Any adhering prevention material can be used for the protection layer. As an example for an adhering prevention material, exemplified are wax, silica particles, styrene containing elastomeric block copolymer (e.g., styrene-butadiene-styrene, styrene-isoprene-styrene), cellulose acetate, cellulose acetate butyrate, cellulose propionate, and mixtures of those are exemplified. A crosslinking agent for crosslinking and a surfactant for improving coating capability or the like can be added to the protection layer.

For the image forming layer and the protection layer of the image forming layer in the photothermographic material of the present invention, a light absorbing substance or a filter dye as described in U.S. Pat. No. 3,253,921, U.S. Pat. No. 2,274,782, U.S. Pat. No. 2,527,583, and U.S. Pat. No. 2,956,879 can be used. Moreover, the dye can be mordanted as described in U.S. Pat. No. 3,282,699. As the use amount of the filter dye, the light absorbing degree at the exposing wavelength is preferably 0.1 to 3, more preferably, 0.2 to 1.5.

The image forming layer in the photothermographic material of the present invention may contain a dye or pigment of various types so as to improve the color tone or prevent the irradiation. Any dye or pigment may be used in the photosensitive layer, and examples thereof include pigments and dyes described in the color index. Specific examples thereof include organic pigments and inorganic pigments such as a pyrazoloazole dye, an anthraquinone dye, an azo dye, an azomethine dye, an oxonol dye, a carbocyanine dye, a styryl dye, a triphenylmethane dye, an indoaniline dye, an indophenol dye and phthalocyanine. Preferred examples of the dye for use in the present invention include anthraquinone dyes (e.g., Compounds 1 to 9 described in JP-A-5-341441, Compounds 3-6 to 3-18 and 3-23 to 3-38 described in JP-A-5-165147), azomethine dyes (e.g., Compounds 17 to 47described in JP-A-5-341441), indoaniline dyes (e.g., Compounds 11 to 19 described in JP-A-5-289227, Compound 47 described in JP-A-5-341441, Compounds 2-10 and 2-11 described in JP-A-5-165147) and azo dyes (Compounds 10 to 16 described in JP-A-5-341441).

The amount of such a compound used may be determined according to the objective absorption amount but, in general, the compound is preferably used in an amount of from $1\times10^{-6}$ g or higher to 1 g or lower, per square meter. The dye may be added in any form of a solution, emulsified product or solid fine particle dispersion or may be added in the state mordanted with a polymer mordant.

The photothermographic material according to the invention is preferably a so-called one side photosensitive material having an image forming layer containing at least one layer of silver halide emulsion on one side of the support, and a back layer on the other side.

With this invention, the back layer preferably has a maximum absorption in a wavelength range of about 0.3 or higher and 2.0 or lower.

If the wavelength range is 750 to 1,400 nm, it is preferable for the back layer that the optical density is equal to or greater than 0.005 and less than 0.5 in a range of 750 to 360 nm, more preferably, that it is an antihalation layer having an optical density equal to or greater than 0.001 and less than 0.3. When the wavelength range is 750 nm or less, the back layer preferably has a maximum absorption equal to or greater than 0.3 less than 2.0 before image forming in the range and more preferably, the antihalation layer having an optical density equal to or greater than 0.005 and less than 0.3 after image forming is used.

There is no particular limitation to a method for lowering the optical density down to the above range after forming images, and exemplified are a method lowering dye density by eliminating colors from heating as described in Belgian Patent No. 733,706, a method for lowering density by eliminating colors from light radiation as set forth in JP-A-54-17,833, and the like.

In the case when an antihalation dye is used in the photothermographic material of the present invention, the dye may be any compound so long as the compound has an objective absorption in the desired wavelength region, the absorption in the visible region can be sufficiently reduced after the processing, and the antihalation layer can have a preferred absorption spectrum form. While examples thereof include those described in the following patent publications, the present invention is by no means limited thereto: as a single dye, the compounds described in JP-A-59-56458, JP-A-2-216140, JP-A-7-13295, JP-A-7-11432, U.S. Pat. No. 5,380,635, JP-A-2-68539 (from page 13, left lower column, line 1 to page 14, left lower column, line 9) and JP-A-3-24539 (from page 14, left lower column to page 16, right lower column); and as a dye which is decolored after the processing, the compounds described in JP-A-52-139136, JP-A-53-132334, JP-A-56-501480, JP-A-57-16060, JP-A-57-68831, JP-A-57-101835, JP-A-59-182436, JP-A-7-36145, JP-A-7-199409, JP-B-48-33692, JP-A-B-50-16648, JP-B-2-41734 and U.S. Pat. Nos. 4,088,497, 4,283,487, 4,548,896 and 5,187,049.

In the photothermographic material of the present invention, the suitable binder for back layer is transparent or semitransparent, and generally colorless and can be a natural polymer, synthetic resin polymer or copolymer, and other media for forming films, such as: gelatin, Arabic rubber, poly(vinyl alcohol), hydroxyethylcellulose, cellulose acetate, cellulose acetate butyrate, poly(vinylprrolidone), casein, starch, poly(acrylic acid), poly(methymethacrylic acid), poly(vinyl chloride), poly(methacrylic acid), copoly (styrene-maleic anhydride), copoly(styrene-acrylonitrile), copoly(styrene-butadiene), poly(vinyl acetal) group such as poly(vinyl formal) and poly(vinyl butyral), poly (ester) group, poly(urethane) group, phenoxy resin, poly (vinylidene chloride), poly(epoxide), poly(carbonate) group, poly (vinyl acetate), cellulose ester group, poly(amide) group. The binder can be covered with water, organic solvent, or emulsion.

In the photothermographic material according to the invention, a matting agent can be added to the protection layer and/or back layer on the image forming layer side, or the protection layer on the back layer side to improve the conveyance property. The matting agent is fine particles of organic or inorganic compounds, which are generally water-insoluble. Arbitrary agents as a matting agent can be used, such as well-known in the art, e.g., organic matting agents described in specifications of U.S. Pat. No. 1,939,213, U.S. Pat. No. 2,701,245, U.S. Pat. No. 2,322,037, U.S. Pat. No. 3,262,782, U.S. Pat. No. 3,539,344, and U.S. Pat. No. 3,767,448, and inorganic agents described in specifications of U.S. Pat. No. 1,260,772, U.S. Pat. No. 2,192,241, U.S. Pat. No. 3,257,206, U.S. Pat. No. 3,370,951, U.S. Pat. No. 3,523,022, U.S. Pat. No. 3,769,020. For example, a water-dispersing vinyl polymer, polymethylacrylate, polymethylmethacrylate, polyacrylonitrile, acrylonitrile-α-methylstyrene, polystyrene, styrene-divinylbenzene copolymer, polyvinyl acetate, polyethylene carbonate, polytetrafluoroethylene, and the like, as a cellulose derivative, methylcellulose, cellulose acetate, cellulose acetate propionate, and the like, as a starch derivative, carboxystarch, carboxynitrophenylstarch, urea-formaldehyde-starch reactant, and the like, as hardened gelatin in use of a known hardening agent, and hardened gelatin of micro capsule hollow particles upon coacervation hardening can be raised. As examples of inorganic compounds, silicon dioxide, titanium dioxide, magnesium dioxide, aluminum oxide, barium sulfate, calciumcarbonate, sliver chloridethat is made less sensitive by a known method, silver bromide of the same, glass, and diatomite can be used. The matting agent mentioned above can be used according to the necessity in mixing substances of different kinds.

There is no particular limitation on the size and shape of the matting agent, and the agent of any grain size can be used. It is preferable to use the grain size of 0.1 μm to 30 μm when this invention is implemented. The grain size profile of the matting agent can be narrow and wide. On the other hand, because the matting agent greatly affects the haze and surface luster of the sensitive material, it is preferable to design the grain size, the shape, and the grain size profile meeting to the condition corresponding to the necessity at a time of production of the matting agent or by mixing of plural matting agents.

It is a preferable embodiment that the matting agent is added to the back layer in this invention, and as a mat degree of the back layer the Beck smoothness is preferably 1200 sec or less and 10 sec or more, and more preferably 700 sec or less and 50 sec or more.

In this invention, the matting agent is preferably contained in an outmost surface layer of the photosensitive material, a layer functioning as an outmost surface layer, and a layer closer to the external surface and preferably contained on a layer functioning as a so-called protection layer of the photothermographic material. The mat degree of the emulsion surface protection layer can be any one as far as the stardust problem does not occur, and it is preferable that the Beck smoothness is 300 sec or more and 5000 sec or less, and particularly, 500 sec or more and 2000 sec or less.

In the photothermographic material of the present invention, the image forming layer is structured of a single or more layers. When the image forming layer is structured of a single layer, the non-photosensitive silver salt, the silver halide, the developing agent, and the binder, and desired additional materials such as color adjuster, covering aid, and other aids should be contained in the single layer. When it is structured of two layers, the non-photosensitive silver salt and the silver halide should be contained in the first emulsion layer (ordinarily a layer adjacent to the support), and some other components should be included in the second layer or both layers. However, a two layer structure is conceivable in which the entire components are contained in the sole emulsion layer and in which a protection layer is contained. The structure of multicolor photosensitive photothermographic material may contain a component of those two layers for each color, and a single layer may contain all components as set forth in U.S. Pat. No. 4,708,928. In the case of multi-dye multicolor photosensitive photothermographic material, each image forming layer may be held generally in being distinctive from one another by using functional or non-functional barrier layers between the respective image forming layers as set forth in U.S. Pat. No. 4,460,681.

A backside resistive heating layer described in U.S. Pat. Nos. 4,460,681 and 4,374,921 may also be used in the present invention.

In the photothermographic material of the present invention, a film hardening agent may be used for respective layers such as the image forming layer, the protection layer, and the back layer. As an example for the film hardening agent, exemplified are polyisocyanate groups as set forth in U.S. Pat. No. 4,281,060, JP-A-6-208,193, and the like, epoxy compound groups as set forth in U.S. Pat. No. 4,791,042 and the like, vinylsulfone based compound groups as set forth in JP-A-62-89048, and the like.

In the photothermographic material of the present invention, a surfactant represented by Formula (2) and another surfactant may be used in combination for improving the coating property, and the electrostatic property, and the like. As examples of the surfactant, any proper materials, such as nonion based, anion based, cation based, fluorine based and the like can be used. More specifically, exemplified are fluorine based polymer surfactants as set forth in JP-A-62-170,950, U.S. Pat. No. 5,380,644, and the like, fluorine based surfactants as set forth in JP-A-60-244, 945, JP-A-63-188, 135, and the like, polysiloxane based surfactants as set forth in U.S. Pat. No. 3,885,965, and the like, polyalkileneoxide as set forth in JP-A-6-301,140, anion based surfactants, and so on.

The photothermographic material according to the invention may include a layer containing, e.g., soluble salts (e.g., choloride, nitrate, etc.), evaporated metal layer, ionic polymers as set forth in U.S. Pat. No. 2,861,056 and U.S. Pat. No. 3,206,312, insoluble inorganic salts as set forth in U.S. Pat. No. 3,428,451, tin oxide as set forth in JP-A-60-252,349, and JP-A-57-104,931, and so on for antistatic effect.

As a method for obtaining color images using the photothermographic materials of the invention, there is a method as set forth in JP-A-7-13,295, 10 page left column 43 line to 11 page left column line 40. As a stabilizer for color dying images, exemplified are British Patent No. 1,326,889, U.S. Pat. No. 3,432,300, U.S. Pat. No. 3,698,909, U.S. Pat. No. 3,574,627, U.S. Pat. No. 3,573,050, U.S. Pat. No. 3,764,337, and U.S. Pat. No. 4,042,394.

The image forming layer and the other layers of the present invention can be coated by various coating operations such as a dipping coating, a air knife coating, flow coating, and extrusion coating using a hopper as set forth in U.S. Pat. No. 2,681,294. Two or more layers, if desired, can be covered at the same time by a method as set forth in U.S. Pat. No. 2,761,791, and British Patent No. 837,095.

The photothermographic material of the invention may contain additional layers, for example, a dye reception layer for receiving movable dye images, non-transparent layer used when a reverse printing is made, a protection top coating layer, primer layers already known in the art of light heat photographic technology, and so on. The sensitive material of the invention preferably can form images with the single sheet only, and it is preferable that the functional layers necessary for forming images such as an image receiving layer or the like are not in another sensitive material.

An exposing apparatus used for image wise exposure of the photothermographic material of the invention can be any apparatus capable of making exposure of $10^{-7}$ seconds or less, and in general, a preferable exposing apparatus uses as a light source an LD (Laser Diode), an LED (Light Emitting Diode). Particularly, the LD is preferable in terms of high output and high resolution. Those light sources can be any thing capable of generating light having an electromagnetic wave spectrum of a targeted wavelength range. For example, as LDs, a dye laser, gas laser, solid laser, semiconductor laser or the like can be used.

In using the photothermographic material of the present invention, exposure means that the light beams of a light source are overlapped to make an exposure, and overlapping here indicates the pitch width of the subscanning is smaller than a beam diameter. Overlap can be expressed in a quantitative manner with FWHM divided by subscanning pitch width (overlap coefficient) where the beam diameter is represented with a full width at half maximum (FWHM) of a beam intensity. In this invention, the overlap coefficient is preferably 0.2 or higher.

The scanning method of a light source of the exposing apparatus used for the photothermographic material of the present invention is not especially limited, and any of a cylindrical outer surface scanning method, a cylindrical inner surface scanning method, a plane scanning method, and the like can be used. The channel of a light source can be either a single channel or multiple channels, and in the case of the cylindrical outer surface method, the multiple channels can be used preferably.

The photothermographic material of the present invention has a low haze at the exposure and is liable to incur generation of interference fringes. For preventing the generation of interference fringes, a technique of entering a laser ray obliquely with respect to the image-recording material disclosed in JP-A-5-113548 and a method of using a multimode laser disclosed in International Patent Publication WO95/31754 are known and these techniques are preferably used.

While the heat developing process may be developed by any method in image forming with the use of the photothermographic material, development is usually performed by elevating the temperature of the photothermographic material after the image wise exposure. As a favorable embodiment of a used heat developing machine, heat developing machines set forth in JP-B-Heisei No. 5-56,499, Japanese Patent No. 684453, JP-A-9-292,695, JP-A-9-297,385, and International Patent WO No. 95/30934 as types in which the photothermographic material is in contact with a heat source such as a heat roller and a heat drum, heat developing machines set forth in JP-B-7-13,294, International Patent Nos. WO 97/28489, WO 97/28488, and WO 97/28487 as non-contact types are exemplified. Amore preferable embodiment is a non-contact type heat developing machine. A preferable development temperature is from 80 to 250° C., more preferably from 100 to 140° C. The development time is preferably from 1 to 180 seconds, more preferably from 10 to 90 seconds.

As a method for preventing processing uneveness due to size deviations during heat development in using the photothermographic material of the present invention, a method for forming images (so called multistage heating method) by heat development at a temperature of 110° C. or higher and 140° C. or less after so heating five seconds or longer at a temperature of 80° C. or higher and less than 115° C. as not to create images is effective.

When the photothermographic material of the present invention is subject to heat developing processing, the material is exposed to a high temperature of 110° C. or higher, so that a part of the components contained in the image recording material, and a part of the dissolved components due to heat development may be evaporated. Those vaporized components may have various adverse effects, such as causing development unevenness, corroding the structural members of the heat developing machine, serving as deposited foreign objects at low temperature places to cause deformation of images, and clinging to images and becoming dirty. To eliminate those effects, an art has been known in which a filter is mounted to the heat developing machine and in which the air flow in the heat developing machine is adjusted in an optimum way. Those can be used in combination.

For example, in WO 95/30933, WO97/21150, JP-W-A-10-500496, a filter cartridge having coupled absorbing particles, a first opening for introducing vaporized components, and a second opening for exhausting the components, used for a heating machine for heating the film in contact with the film is described. In WO 96/12213, JP-W-A-10-507403, a filter is described in which a thermal conductive condensing collector and a gas absorption fine particle filter are combined.

In U.S. Pat. 4518845, JP-B-3-54331, a structure is described in having an machine removing steam from the film, a pressing apparatus for pressing the film to a heat conducting member, and an apparatus for heating the heat conducting member. In WO98/27458, components increasing fogs vaporized from the film are removed from the film surface.

FIG. 1 shows a structural example of a heat developing machine used for heat developing process of the photothermographic material of the invention. FIG. 1 shows a side view of the heat developing machine. The heat developing machine shown in FIG. 1 includes a feeding roller pair 11 (an upper roller is a roller made of silicon rubber; a lower roller is the heating roller made of aluminum) for feeding the photothermographic material 10 in a plane manner in correcting and preliminary heating the material 10 into a heating section and another feeding roller pair 12 for feeding the photothermographic material 10 in a plane manner in correcting the material 10 after heat development. The photothermographic material 10 is subject to heat development during feeding from the feeding roller pair 11 to the feeding roller pair 12. A conveying means for conveying the photothermographic material 10 during the heat development has a plurality of rollers 13 on a side with which a surface having the image forming layer is in contact and a smooth surface 14 to which a nonwoven fabric (e.g., made of aromatic polyamide or Teflon) or the like is adhered on a side where the back surface in opposition to the above side is in contact. The photothermographic material 10 is conveyed by drive of the plural rollers 13 in contact with the surface having the image forming layer where the back surface slides on the smooth surface 14. As a heating means, heaters 15 are installed over the rollers 13 and below the smooth surface 14 so that the double sides of the photothermographic material 10 is heated. As a heating means in this situation, panel heaters and the like are exemplified. The clearance between the rollers 13 and the smooth surface 14 may vary depending on the member of the smooth surface but is adjusted to a certain clearance capable of feeding the photothermographic material 10. It is preferably 0 to 1 mm.

The material of the surface of each roller 13 and the member of the smooth surface 14 can be any material as far as durable at a high temperature and not raising any problem to feed the photothermographic material 10. The material of the roller surface is preferably silicon rubber, and the member of the smooth surface is preferably of a nonwoven fabric made of aromatic polyamide or Teflon (PTFE). As a heating means, plural heaters are used, and each preferably is controlled to set freely its heating temperature.

Although the heating section is constituted of the preliminary heating section A having the feeding roller pair 11 and a heat developing processing section B having the heaters 15, the preliminary heating section A located on an upstream side of the heat developable processing section B is preferably set at a temperature lower than the heat developing temperature (e.g., about 10 to 30° C. lower) where a temperature and time adequate for evaporating the moisture content of the photothermographic material 10 are set, and more preferably, at a temperature higher than the glass transition temperature (Tg) of the support of the photothermographic material 10 as not to create unevenness in development.

A guide plate 16 is disposed on a downstream side of the heat developing processing section B, and a slowly cooling section C having the conveyance roller pair 12 and the guide plate 16 is also disposed.

The guide plate 16 is preferably made of a material having a low heat conducting rate, and cooling preferably is done gradually not to cause deformation of the photothermographic material 10.

The machine is illustrated according to the illustrated example, but the heat developing.machine is not limited to this, and the heat developing machine used in this invention can have various structures as set forth in, e.g., JP-A-7-13,294. In the case of the multistage heating method used preferably in this invention, with the above machine or the like, two or more heat sources having different heating temperatures are installed, and they are heated at different temperatures continuously.

EXAMPLES

The present invention will be specifically explained with reference to following Examples. Materials, use amounts, ratios, processing contents, manipulations and the like shown in the following examples can be optionally changed so long as such change does not depart from the spirit of the present invention. Therefore, the scope of the present invention is not limited to the following examples.

Example 1

(1) Production of PET Support

Using a terephthalic acid and an ethylene glycol, according to a normal method, a PET of IV (intrinsic viscosity)=66 (measured at 25° C. in phenol/tetrachloroethane=6/4 (ratio by weight)) was obtained. After this was made into pellets, they are dried for four hours at 130° C. After extruded from a T-shape die after melted at 300° C., the material was rapidly cooled, and non-drawn film was produced with a thickness such that the film thickness after getting thermal stability was 120 $\mu$m.

This film was longitudinally drawn 3.3 times using rollers having different peripheral speeds from one another and transversely drawn 4.5 times using a tenter. At that time, the temperatures are 110° C. and 130° C., respectively. Then, 4% relaxation was made in the transverse direction at the temperature of 240° C. after thermally stabilizing the film at the same temperature for 20 seconds. Subsequently, the chuck of the tenter was released, the both edges of the film were knurled, and the film was rolled at 4.8 kg/cm$^2$. Thus, a roll shaped PET support was obtained with a width of 2.4 m, a length of 3,500 m, and a thickness of 120 $\mu$m.

(2) Undercoating Layer Application

The undercoating layer (a) and the undercoating layer (b) with below compositions were coated sequentially on one side of the PET support obtained in (1), and those were dried for four minutes at 180° C. The thickness of the undercoating layer after dried was 2.0 $\mu$m.

(2-1) Undercoating Layer (a) Composition

| (2-1) Undercoating layer (a) composition | |
|---|---|
| Polymer latex (X) (polymer latex of core and shell type having a core portion of 90% by weight and a shell portion of 10% by weight; core portion is vinylidene chloride/methylacrylate/methylmethacrylate/acrylonitrile/acrylic acid = 93/3/3/0.9/0.1 (% by weight) shell portion is vinylidene chloride/methylacrylate/methylmethacrylate/acrylonitrile/acrylic acid = 88/3/3/3/3 (% by weight); Weight average molecular weight: 38000) | Solid portion amount 3.0 g/m$^2$ |
| 2,4-dichloro-6-hydroxy-s-triazine | 23 mg/m$^2$ |
| Matting agent (polystyrene; average diameter: 2.4 $\mu$m; coefficient of variation of the average diameter: 7%) | 1.5 mg/m$^2$ |
| (2-2) Undercoating layer (b) composition | |
| Deionized gelatin ($Ca^{2+}$ contained amount: 0.6 ppm; jelly strength; 230 g) | 50 mg/m$^2$ |

(3) Back Layer Forming

An electroconductive layer and a protection layer mentioned above were coated sequentially on one side of the support obtained in (2), and those were dried for four minutes at 180° C. to form a back layer.

(3-1) Electroconductive Layer Composition

| | |
|---|---|
| Julimer ET-410 (Nihon Junyaku Co., Ltd.) | 96 mg/m$^2$ |
| Alkali processed gelatin (molecular weight: about 10000; $Ca^{2+}$ contained amount: 30 ppm) | 72 mg/m$^2$ |
| Deionized gelatin ($Ca^{2+}$ contained amount: 0.6 ppm) | 8 mg/m$^2$ |
| Compound A having the following structure | 0.2 mg/m$^2$ |

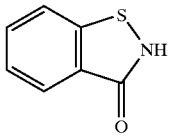

| | |
|---|---|
| Polyoxyethylenephenylether | 10 mg/m$^2$ |
| Sumitex Resin M-3 (water-soluble melamine compound, Sumitomo Chemical Industry (K.K.) made) | 18 mg/m$^2$ |
| Dye A having the following structure Coating amount so as to have an optical density of 783 nm equal to 1.2 | |

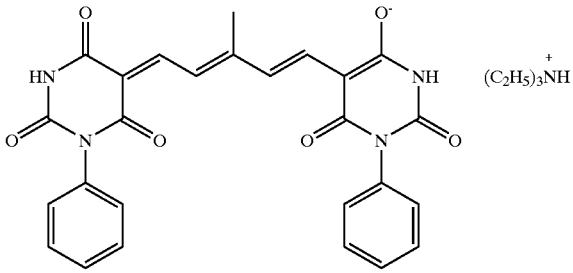

| | |
|---|---|
| $SnO_2$/Sb (weight ratio: 9/1, needle shaped fine particles, major/minor axis = 20 to 30, Isihara Sangyo K.K. made) | 160 mg/m$^2$ |
| Matting agent (Polymethyl methacrylate, mean particle size: 5 $\mu$m) | 7 mg/m$^2$ |

(3-2) Protection Layer Composition

| (3-2) Protection layer composition | |
|---|---|
| Polymer latex (Y) (methyl methacrylate/styrene/2-ethylhexyl acrylate/2-hydroxyethyl methacrylate/acrylic acid = 59/9/26/5/1 (copolymer: % by weight)) | Solid portion amount 1000 mg/m$^2$ |
| Polystyrene sulfonate (molecular weight: 1000 to 5000) | 2.6 mg/m$^2$ |
| Cellosol 524 (Chukyo Oil and Fat Co., Ltd.) | 25 mg/m$^2$ |
| Sumitex Resin M-3 (water-soluble melamine compound, Sumitomo Chemical Industry (K.K.) made) | 218 mg/m$^2$ |

(4) Conveyance Heating Processing (4-1) Heating Processing

The PET support with the undercoating layer and the back layer obtained by (3) was put in a heating processing zone having whole length of 200 m, and was conveyed at a tension of 3 kg/cm$^2$, conveyance rate of 20 m/min. Thus, heating processing was performed.

(4-2) Post-heating Processing

Subsequently to the thermal processing in (4-1) as mentioned above, the material was wound up after post-heating processing where heating processing in the zone at 40° C. was performed for 15 seconds. At that time, winding tension was 10 kg/cm$^2$.

(5) Preparation of Image Forming Layer Coating Liquid (5-1) Preparation of Non-photosensitive Silver Salt (Behenic Acid Silver) Dispersion 87.6 g of behenic acid made of Henkel (product name Edenor C22-85R), 423 ml of a distilled water, 49.2 ml of 5N-NaOH solution, and 120 ml of tert-butyl alcohol were mixed to obtain a sodium behenic acid solution by stirring the mixture at 75° C. for one hour to be reacted. Separately, 206.2 ml of an aqueous solution of 40.4 g of silver nitrate was prepared and kept at a temperature of 10° C. A reaction container in which 635 ml of the distilled water and 30 ml of the tert-butyl alcohol were placed was kept at a temperature of 30° C., to which the above sodium behenic acid solution of the entire amount and the silver nitrate aqueous solution of the entire amount were added at a constant flow rate for 62 minutes 10 seconds and 60 minutes, respectively, while stirred. At that time, for 7 minutes 20 seconds after beginning of addition of the silver nitrate aqueous solution, only the silver nitrate aqueous solution was added; subsequently, the sodium behenic acid solution start to be added; and for 9 minutes 30 seconds after addition of the silver nitrate aqueous solution, only the sodium behenic acid solution was added. During this processing, the temperature inside the reaction container was kept at 30° C., and the solution was controlled as not to raise the liquid temperature. The piping system for addition of the sodium behenic acid solution was to keep the temperature by a steam trace and to control the steam amount so that the liquid temperature at the outlet of the addition nozzle tip became 75° C. The piping system for addition of the sodium silver nitrate was to keep the temperature by circulating cool water outside a double pipe. The addition position of the sodium behenic acid solution and the addition position of the sodium silver nitrate were located symmetrically with respect to a stirring axis as a center, and were adjusted to be at a level not to contact with the reactive liquid.

After the completion of addition of the sodium behenic acid solution, the solution was stirred for twenty minutes at a temperature as it was and left over to decrease the temperature to 25° C. Subsequently, the solid content was separated by suction filtration, and the solid content was washed with water until the conductivity of the filtered water became 30 μS/cm. The solid content obtained as described above was preserved as a wet cake without being dried. Where conditions of the particles of thus obtained behenic acid silver was evaluated with an electronic microscope photography, the crystals were in a scale shape, having an average projection area size of 0.52 μm, an average particle thickness of 0.14 μm, and coefficient of variation of the average sphere corresponding diameter of 15%.

A polyvinyl alcohol (goods name: PVA-217, average polymerization degree of about 1700) of 7.4 g and water were added to the wet cake corresponding to 100 g of dried solid portion, and it was adjusted to be 385 g as the whole weight and then preliminarily dispersed at a homo mixer. Then, the original liquid already preliminarily dispersed was treated three times where the pressure of the dispersing machine (goods name: Microfluidizer M-110S-EH, Microfluidics International Corporation made, with G10Z interaction chamber) is adjusted to 1750 kg/m$^2$ and handled three times to obtain the behenic acid silver dispersion. The cooling control is made by attaching the meander type heat exchangers in the front of and at the rear of the interaction chamber, and the desired dispersion temperature was set by adjusting the temperature of the coolant.

Thus obtained behenic acid silver particles contained in the behenic acid silver dispersion were particles having the volume weighted mean diameter of 0.52 μm, and coefficient of variation of the average sphere corresponding diameter of 15%. The measurement of the particle size was made by Master Sizer X made of Malvern Instruments Ltd. Where evaluation was made by the electronic microscope photography, the particles had the ratio of the major axis tominor axis of 1.5, the particle thickness of 0.14 μm, and the average aspect ratio (ratio of the circle corresponding diameter of the projected area of the particles to particle thickness of 5.1.

(5-2) Preparation of Photosensitive Silver Halide Emulsion A

Into 700 ml of water, 11 g of alkali-processed gelatin (calcium containing amount of 2700 ppm or less), 30 mg of potassium bromide and 10 mg of sodium benzene thiosulfonate were dissolved, and after adjusting the pH to 5.0 at a temperature of 40° C., 159 ml of an aqueous solution containing 18.6 g of silver nitrate and an aqueous solution containing 1 mol/l of potassium bromide, $5\times10^{-6}$ mol/l of $(NH_4)_2RhCl_5$ $(H_2O)$, and $2\times10^{-5}$ mol/l of $K_3IrCl_6$ were added by the control double jet method over 6 minutes and 30 seconds while keeping the pAg at 7.7. Subsequently, 476 ml of an aqueous solution containing 55.5 g of silver nitrate and a solution containing 1 mol/l of potassium bromide and $2\times10^{-5}$ mol/l of $K_3IrCl_6$ were added by the control double jet method over 28 minutes and 30 seconds while keeping the pAg at 7.7.

Thereafter, desalting processing was made where the pH was lowered to cause coagulation precipitation, and then 0.17 g of Compound A shown in (3-1) and 51.1 g of low molecular weight gelatin (calcium containing amount is 20 ppm) having an average molecular weight amount of 15,000 were added to adjust the material to have the pAg at 8.0 with the pH 5.9. The obtained particles had a mean particle size of 0.08 μm, a coefficient of variation of the projected area of 9%, and a (100) face ratio of 90% and were cubic particles.

The silver halide particles thus obtained was warmed to 60° C. and added with sodium benzene thiosulfonate in an amount of 76 μmol per mol of silver, and after 3 minutes, triethyl thiourea of 71 μmol was added, ripened for 100 minutes, it was cooled to 40° C. after adding 4-hydroxy-6-methyl-1,3,3a,7-tetrazaindene of $5\times10^{-4}$ mol.

Subsequently, it was kept at 40° C., added with $12.8\times10^{-4}$ mol of the below sensitizing dye A (added as ethanol solution) per mol of silver halide and the compound B of $6.4\times10^{-3}$mol, per mol of silver halide, in stirring those. After rapidly cooling it to 30° C. after 20 minutes, the preparation of photosensitive silver halide emulsion A was finished.

Sensitizing dye A

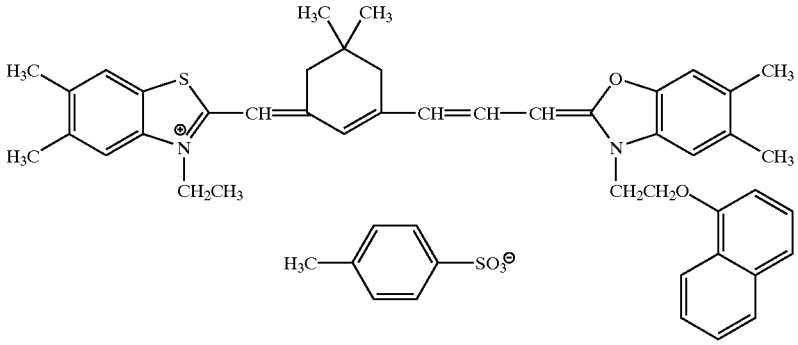

Compound B

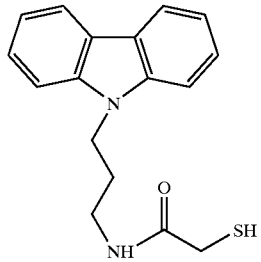

(5-3) Preparation of Solid Fine Particle Dispersion of Nucleation Agent

To 10 g of a nucleation agent as set forth in Table 1, 2.5 g of a polyvinyl alcohol (made by Kuraray Co., Ltd.), and 87.5 g of water were added and sufficiently stirred to form a slurry. The slurry was left for three hours. Subsequently, the slurry was introduced into a vessel together with 240 g of zirconia beads of 0.5 mm, and dispersed in a dispersing machine (1/4G Sand Grinder Mill, Imex Co., Ltd.) for 10 hours to prepare a solid fine particle dispersion. The particle size was 0.1 μm or larger and 1.0 μm or less with 80% by weight of particles, and the mean particle size was 0.5 μm (5-4) Preparation of Solid Fine Particle Dispersion of Reducing Agent To 25 g of 1,1-bis(2-hydroxy-3,5-dimethylphenyl)-3,5,5-trimethylhexane, 25 g of a 20% by weight water solution of MP-203 of MP polymer, made by Kuraray Co., Ltd., 0.1 g of Safinol 104E, Nisshin Kagaku K.K. made, 2 g of methanol, and 48 g of water were added and sufficiently stirred to form a slurry. The slurry was left for three hours. Subsequently, the slurry was introduced into a vessel together with 360 g of zirconia beads of 1 mm, and dispersed in a dispersing machine (1/4G Sand Grinder Mill, Imex Co., Ltd.) for 3 hours to prepare a reducing agent solid fine particle dispersion. The particle size was 0.3 μm or larger and 1.0μm or less with 80% by weight of particles.

(5-5) Preparation of Solid Fine Particle Dispersion of Polyhalogen Compound

To 30 g of a polyhalogen compound A described in the formula below, 4 g of MP-203 of MP polymer made by Kuraray Co., Ltd., 0.25 g of compound C described in the formula below, and 66 g of water were added and sufficiently stirred. Subsequently, the slurry was introduced into a vessel together with 200 g of zirconia beads of 0.5 mm, and dispersed in a dispersing machine (1/16G Sand Grinder Mill, Imex Co., Ltd.) for 5 hours to prepare a solid fine particle dispersion. The particle-size was 0.3 μm or larger and 1.0 μm or less with 80% by weight of particles.

Polyhalogen compound A

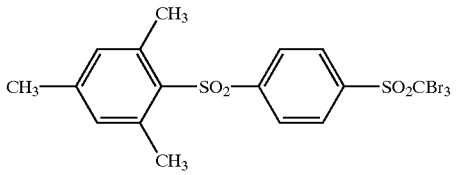

Compound C

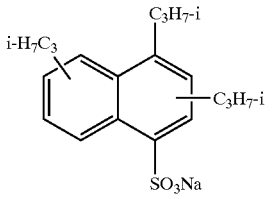

With respect to polyhalogen compound-B described in the formula below, a solid fine particle dispersion was prepared in substantially the same way as the polyhalogen compound-A, and particle size substantially the same was obtained.

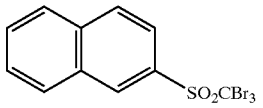

(5-6) Preparation of Solid Fine Particle Dispersion of Zinc Compound

To 30 g of compound Z shown in the formula below, 3 g of MP-203 of MP polymer made by Kuraray Co., Ltd., and 87 ml of water were added and sufficiently stirred. The slurry was left for three hours. Subsequently, the slurry was treated in substantially the same manner as preparation of the reducing agent solid fine particle dispersion mentioned above (5-4) to prepare a solid fine particle dispersion of the compound Z. The particle size was 0.3 μm or larger and 1.0 μm or less with 80% by weight of particles.

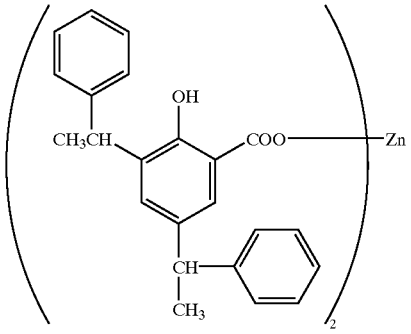

(5-7) Preparation of Coating Solution for Image Forming Layer

To silver 1 mol of the thus produced non-photosensitive silver salt (behenic acid silver) dispersion in the aforementioned (5-1), the following components are added, water is added, and an image forming layer coating liquid was prepared.

| | |
|---|---|
| silver halide emulsion A obtained in (5-2) | 0.06 mol as Ag amount |
| solid fine particle dispersion of nucleation agent obtained in (5-3) kinds and amounts (mol) as set forth in Table 1 | |
| solid fine particle dispersion of reducing agent obtained in (5-4) | 149 g as a solid portion |
| solid fine particle dispersion of polyhalogen compound-A obtained in (5-5) | 0.06 mol as a solid portion |
| solid fine particle dispersion of polyhalogen compound-B obtained in (5-5) | 0.02 mol as a solid portion |
| solid fine particle dispersion of zinc compound obtained in (5-6) | 9.7 g as a solid portion |
| Binder; LACSTAR3307B (Dainippon Ink & Chemicals, Inc., SBR latex, glass transition temperature Tg = 17° C.) | 397 g as a solid portion |
| sodium ethylthiosulfate | 0.30 g |
| benzotriazole | 1.04 g |
| polyvinyl alcohol (PVA-235 (Kuraray Co., Ltd.)) | 10.8 g |
| 6-iso-propylephthalazin | 15.0 g |
| orth-sodium dihydrogen phosphate, dihydrate dye A described in below structural formula coating amount such that the optical density of 783 nm is 0.3 (typically 0.37 g of solid portion); coated as a mixing solution with low molecular weight gelatin having an average molecular weight of 15,000) | 0.37 g |

Dye A

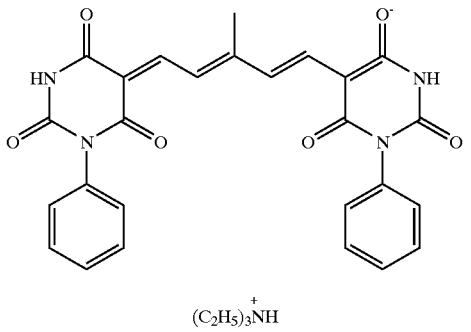

(6) Preparation of Coating Liquid for Protection Layer of Image Forming Surface

Water was added to 956 g of a polymer latex of methyl methacrylate/styrene/2-ethylhexyl acrylate/2-hydroxyethyl methacrylate/acrylic acid=58.9/8.6/25.4/5.1/2 (% by weight) with a particle size of 120 nm, (copolymer; glass transition temperature Tg; 57° C., solid concentration of 21.5% by weight, compound D, shown below as a structural formula, as a film forming aid; 15% by weight).

Compound D

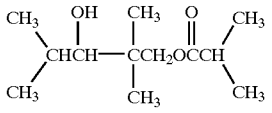

Subsequently added were Compound E, shown below as a structural formula, of 1.62 g, a matting agent (polystyrene particle, mean particle size 7 μm) of 1.98 g, and polyvinyl alcohol (PVA-235 (Kuraray Co., Ltd.)) of 23.6 g. Furthermore, water was added to prepare a coating liquid of the protection layer (a) of the image forming surface.

Compound E

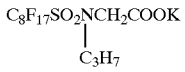

(6-2) Preparation of Coating Liquid for Protection Layer (b) Coating Liquid of the Image Forming Surface Water was added to 630 g of a polymer latex of methyl methacrylate/styrene/2-ethylhexyl acrylate/2-hydroxyethyl methacrylate/acrylic acid=58.9/8.6/25.4/5.1/2 (% by weight) with a particle size of 70 nm, (copolymer; glass transition temperature Tg; 54° C., solid concentration of 21.5% by weight, compound D, shown in (6-1) as a film forming aid; 15% by weight), and added successively with 6.30 g of solution of 30% by weight of carnauba wax (Chukyo Oil and Fat Co., Ltd. Cellosol 524: silicone containing amount of less than 5 ppm), and then the compound shown in Formula (1) and the compound shown in Formula (2) described in Table 1 were further added where the amounts were added according to the described amounts in Table. 0.01 mol of the compound G shown below as a structural formula, 1.18 g of a matting agent (polystyrene particles, mean particle size 7 μm), and 8.30 g of polyvinyl alcohol (PVA-235 (Kuraray Co., Ltd.)), as well as water and $NH_4OH$ were added, thereby preparing the protection layer (b) coating liquid of the image forming surface such that film surface pH of the photothermographic material can be a value described in Table 1.

Compound G

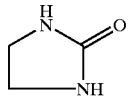

(7) Preparation of the Photothermographic Material

The image forming layer coating liquid obtained in the above (5) was coated as to make the coated sliver amount 1.6 g/m$^2$ on the undercoating layer (a) and the undercoating layer (b) of the PET support on a side opposite to a side where a back layer is applied. The protection layer (a) coating liquid of the image forming surface obtained in the above (6-1) was coated simultaneously together with the aforementioned liquid so that the solid coating amount of the polymer latex was 1.31 g/m$^2$. After this, the protection layer (b) coating liquid of the image forming surface obtained in the above (6-2) was coated so that the solid coating amount of the.polymer latex was 3.02 g/m$^2$to produce a photothermographic material. The obtained film surface pH on the image forming side of the photothermographic material was a value shown in Table 1 and Beck smoothness was 850 seconds; the film surface pH on the opposite side was 5.9 and Beck smoothness was 560 seconds.

(8) Evaluation of Photographic Property (8-1) Exposing Processing

The photothermographic material obtained in the above (7) was exposed for $2\times10^{-8}$ using a laser exposing apparatus of a single channel cylindrical inner surface type on which a semiconductor laser is mounted with beam diameter (FWHM, a half of beam intensity) of 12.56 μm, laser output of 50 mW, and output wavelength of 783 nm in adjusting the exposure time by changing the mirror rotary number and the exposure amount by changing the output value. The overlap coefficient at that time was 0.449.

(8-2) Heat Development Processing

The exposed photothermographic material obtained in (8-1) was subject to a heat development processing using the heat developing machine as shown in FIG. 1 for 14.4 seconds at the preliminary heating section (drive systems of the preliminary heating section and the thermal development processing section are individually formed; difference in speed therefrom the thermal development processing section is set at −0.5% to −1%; temperature and time of the metal roller of respective pre-heating sections is for 2.4 seconds at 67° C. in the first roller; for 2.4 seconds at 82° C. in the second roller; for 2.4 seconds at 98° C. in the third roller; for 2.4 seconds at 107° C. in the forth roller; for 2.4 seconds at 115° C. in the fifth roller; and for 2.4 seconds at 120° C. in the sixth roller), for 20.3 seconds at a temperature 120° C. (temperature of photothermographic material surface) at the thermal development processing section and for 16 seconds (the temperature was slowly successively decreased from 120° C. to 60° C. in a cooling rate of −3.75° C. per second) at the slowly cooling section, with a conveying linear speed of 21.2 mm per second where the roller surface material was a silicon rubber and where the smooth surface was a Teflon non-woven fabric at the heat development processing section. Temperature accuracy in the transverse direction was ±0.5° C. The temperature accuracy was given by setting each temperature of the rollers where each side of the photothermographic material has another 5 cm added from its width (e.g., width is 61 cm), and where temperature was also applied to the added portions. It is to be noted that, since the temperature of both the end portions of each of rollers was decreased rapidly, temperature was set so that the portion of 5 cm added from the width of the photothermographic material was 1 to 3° C. higher than that of the roller center portion, thus to have a uniform finish of the image density of the photothermographic material (e.g., in the width of 61 cm).

(8-3) Evaluation of Photographic Performance

The exposing processing in the (8-1) and the heat development processing in the (8-2) were performed under the environment at 25 ° C. and 30% RH. It is to be noted that the photothermographic material was kept for 16 hours or more under this environment to have a certain level of moisture content before the above exposing processing and the heat development processing.

The obtained images were evaluated using a Macbeth TD904 densitometer (visible density). The results were evaluated by Dmin (fog), Dmax (maximum density), and y (contrast: a value of the gradient of a straight line connecting points of densities 0.2 and 2.5 with each other, where the logarithm of the exposure amount was abscissa). (8-4) Evaluation of coated surface condition on the image forming layer side For evaluation of the coated surface condition of the photothermographic material, a coated surface of 1 m was evaluated and the number of repellency at this time was measured.

The results that the above evaluations were made are shown in Table 1 with respect to each photothermographic material.

TABLE 1

| Photothermographic material | Compound of Formula (1) Type | Compound of Formula (1) Addition amount (mol) | Compound of Formula (2) Type | Compound of Formula (2) Addition amount (g) | Nucleation agent Type | Nucleation agent Addition amount (mol) | Film surface pH | Dmin | Dmax | γ (Contrast) | Repellency number (Piece/m$^2$) |
|---|---|---|---|---|---|---|---|---|---|---|---|
| 1 | — | — | Compound E | 0.93 | — | — | 6.8 | 0.11 | 0.11 | Evaluation Unavailable | 0 |
| 2 | — | — | K-26 | 0.93 | — | — | 6.8 | 0.11 | 0.11 | Evaluation Unavailable | 0 |
| 3 | — | — | Compound E | 0.93 | C-62 | $3 \times 10^{-2}$ | 5.2 | 0.12 | 0.12 | Evaluation Unavailable | 0 |
| 4 | — | — | K-26 | 0.93 | C-62 | $3 \times 10^{-2}$ | 5.2 | 0.12 | 0.12 | Evaluation Unavailable | 0 |
| 5 | A-2 | $4.4 \times 10^{-2}$ | Compound E | 0.93 | C-62 | $3 \times 10^{-2}$ | 5.2 | 0.12 | 4.1 | 12 | 12 |
| 6 (invention) | A-2 | $4.4 \times 10^{-2}$ | K-26 | 0.93 | C-62 | $3 \times 10^{-2}$ | 5.2 | 0.12 | 4.1 | 12 | 0 |
| 7 | A-2 | $4.4 \times 10^{-2}$ | Compound E | 0.93 | C-62 | $3 \times 10^{-2}$ | 6.5 | 0.12 | 3.2 | 4 | 0 |
| 8 (invention) | A-2 | $4.4 \times 10^{-2}$ | K-26 | 0.93 | C-62 | $3 \times 10^{-2}$ | 4.9 | 0.12 | 4.3 | 13 | 0 |
| 9 (invention) | A-2 | $4.4 \times 10^{-2}$ | K-14 | 0.93 | C-62 | $3 \times 10^{-2}$ | 5.2 | 0.12 | 4.1 | 12 | 0 |
| 10 (invention) | A-2 | $4.4 \times 10^{-2}$ | K-21 | 0.93 | C-62 | $3 \times 10^{-2}$ | 5.2 | 0.12 | 40 | 10 | 0 |
| 11 (invention) | A-1 | $4.4 \times 10^{-2}$ | K-26 | 0.93 | C-62 | $3 \times 10^{-2}$ | 5.2 | 0.12 | 4.2 | 12 | 0 |
| 12 (invention) | A-24 | $4.4 \times 10^{-2}$ | K-26 | 0.93 | C-62 | $3 \times 10^{-2}$ | 5.2 | 0.12 | 4.1 | 12 | 0 |
| 13 (invention) | A-2 | $4.4 \times 10^{-2}$ | K-26 & K-14 | 0.93 0.22 | C-62 | $3 \times 10^{-2}$ | 5.2 | 0.12 | 4.1 | 12 | 0 |
| 14 | A-2 | $4.4 \times 10^{-2}$ | Compound E | | C-62 | $3 \times 10^{-2}$ | 5.8 | 0.12 | 3.7 | 7 | 5 |
| 15 (invention) | A-2 | $4.4 \times 10^{-2}$ | K-26 | 0.93 | C-64 | $1 \times 10^{-2}$ | 5.2 | 0.12 | 4.0 | 11 | 0 |
| 16 (invention) | A-2 | $4.4 \times 10^{-2}$ | K-26 | 0.93 | C-1 | $1 \times 10^{-2}$ | 5.2 | 0.12 | 4.1 | 12 | 0 |
| 17 (invention) | A-2 | $4.4 \times 10^{-2}$ | K-26 | 0.93 | C-8 | $1 \times 10^{-2}$ | 5.2 | 0.12 | 40 | 11 | 0 |
| 18 (invention) | A-2 | $4.4 \times 10^{-2}$ | K-26 | 0.93 | C-62 | $3 \times 10^{-2}$ | 5.8 | 0.12 | 3.8 | 8 | 0 |

According to the photothermographic material of the invention, it is turned out that good performance such as a low Dmin (fog), a high Dmax (maximum density), and a good coated condition (the number of repellency).

On the other hand, it is apparent that a high Dmax required for photomechanical process application is not provided when the compound represented by Formula (1) and nucleation agent are not added. It is to be noted that, when Compound E or the compound represented by Formula (2) was not added to the protection layer (b) coating liquid of the image forming surface, the coated surface had lines, thereby incapable of evaluating the photographic performance.

As mentioned above, the present invention can provide, advantageously in terms of environments and costs, a photothermographic material for scanners, image setters or the like which is suitable for photomechanical processes and is capable of obtaining such images optimal for photomechanical processes as having a high Dmax (maximum density), a low fog, a good coated surface condition, and less surface defects such as reppellency, coating lines or the like.

What is claimed is:

1. A photothermographic material comprising on a support a non-photosensitive silver salt, a photosensitive silver halide, a nucleation agent, and a binder, wherein a layer is formed on or above an image forming layer comprising the photosensitive silver halide, said layer comprising:

one or more organic acid compounds represented by the following Formula (1), (1)

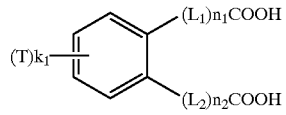

where T represents a univalent substituent and $k_1$ represents an integer of from 0 to 4; in the case of $k_1>2$, more than one T may be the same or different from one another and may be combined to form a ring; $L_1$ and $L_2$ each represents a bivalent linking group; $n_1$ and $n_2$ each independently represents an integer of from 0 to 30, and one or more compounds represented by the following Formula (2), $$R-(A)_n-Y \quad (2)$$

where R represents an alkyl group selected from the group consisting of perfluorohexyl, perfluoroheptyl, perfluorooctyl, perfluorononyl, perfluorodecyl, perfluorododecyl, and perfluorohexadecyl; A represents a bivalent linking group; n represents an integer of from 0 to 50; Y represents —$SO_3M$ or —$OSO_3M$; M represents a hydrogen atom, an alkali metal atom, alkaline-earth metal atom, an ammonium group or a lower alkylamine.

2. The photothermographic material according to claim 1, wherein T in Formula (1) is selected from the group consisting of alkyl groups, alkenyl groups, aryl groups, alkoxy groups, aryloxy groups, acyl groups, acyloxy groups, alkoxycarbonyl groups, acylamino groups, alkoxycarbonylamino groups, aryloxycarbonylamino groups, sulfonylamino groups, sulfamoyl groups, carbamoyl groups, ureido groups, phosphoric acid amido groups, hydroxyl groups, carboxyl groups, sulfo groups, sulfino groups, sulfonyl groups, halogen atoms, cyano group, nitro group, heterocyclic groups, [3,4] benzo groups, [4,5] benzo groups, [4,5] naptho groups, [3,4] methylenedioxy groups, and [4,5] methylenedioxy groups.

3. The photothermographic material according to claim 2, wherein T in Formula (1) is selected from the group consisting of alkyl groups, aryl groups, alkoxy groups, aryloxy groups, acyl groups, acylamino groups, sulfonylamino groups, sulfamoyl groups, carbamoyl groups, hydroxyl groups, sulfonyl groups, halogen atoms, cyano group, [3,4] benzo groups, [4,5] benzo groups, [3,4] methylenedioxy groups, and [4,5] methylenedioxy groups.

4. The photothermographic material according to claim 3, wherein T in Formula (1) is selected from the group consisting of alkyl groups, aryl groups, alkoxy groups, [4,5] benzo groups and [4,5] methylenedioxy groups.

5. The photothermographic material according to claim 1, wherein $L_1$ and $L_2$ in Formula (1) is each independently a bivalent linking group where the linking chain is comprised of 1 to 4 atoms.

6. The photothermographic material according to claim 5, wherein $L_1$ and $L_2$ in Formula (1) is each independently —$CH_2$—, —$CH_2CH_2$—, —C(=O)—, —CONH— or —$SO_2NH$—.

7. The photothermographic material according to claim 6, wherein $n_1$ and $n_2$ in Formula (1) is each independently 0, 1 or 2.

8. The photothermographic material according to claim 1, wherein the organic acid compound represented by Formula (1) is present in an amount of from $10^{-4}$ mol to 10 mol per one mol of silver.

9. The photothermographic material according to claim 8, wherein the organic acid compound represented by Formula (1) is present in an amount of from $10^{-3}$ mol to 1 mol per one mol of silver.

10. The photothermographic material according to claim 1, wherein A in Formula (2) is selected from a group consisting of alkylene groups, arylene groups, and aralkylene groups which may be substituted or unsubstituted.

11. The photosensitive material according to claim 10, wherein A in formula (2) is $(CH_2)_l$, $(CH_2CH_2O)_m$, $(CH(CH_3)CH_2)_p$, $(CH_2CH(OH)CH_2)_q$, phenylene, naphthylene, xylelene, O, COO, $CON(R^{11})$, SO, $SO_2$, or $SO_2N(R^{12})$ wherein $R^{11}$ and $R^{12}$ each independently represents a hydrogen atom, a substituted or unsubstituted alkyl or alkylenyl group having 1 to 20 carbon atoms, and l, m, p or q each represents an integer of from 0 to 20.

12. The photothermographic material according to claim 1, wherein M in Formula (2) is a hydrogen atom, an alkali metal atom, an alkaline-earth metal atom, an ammonium group or a mono-, di-, or tri-lower alkyl amine group having 1 to 10 carbon atoms.

13. The photothermographic material according to claim 1, wherein the compound represented by Formula (2) is present in an amount of from 0.0001 to 1 g per 1 $m^2$ of the photothermographic material.

14. The photothermographic material according to claim 1, Wherein the compound represented by Formula (2) is present in an amount of from 0.0003 to 0.1 g per 1 $m^2$ of the photothermographic material.

15. The photothermographic material according to claim 1, wherein the image forming layer comprises a polymer, latex having a glass transition temperature of −30° C. to 40° C. as a binder in an amount of 50% by weight or higher of the total content of binders in the image forming layer.

16. The photothermographic material according to claim 1, wherein the image forming layer comprises a polymer latex having a glass transition temperature of −30° C. to 40° C. as a binder in an amount of 70% by weight or higher of the total content of binders in the image forming layer.

17. The photothermographic material according to claim 1, wherein the nucleation agent is one or more compounds selected from a group consisting of:

a substituted alkene derivative represented by the following Formula (3), (3)

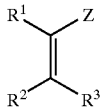

where $R^1$, $R^2$ and $R^3$ each independently represents a hydrogen atom or a substituent, Z represents an electron withdrawing group or asilyl group, and $R^1$ and Z, $R^2$ and $R^3$, $R^1$ and $R^2$, and/or $R^3$ and Z may be combined with each other to form a ring, a substituted isoxazole derivative represented by the following Formula (4), (4)

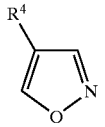

where $R^4$ represents a substituent, and an acetal compound represented by the following Formula (5), (5)

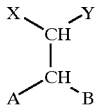

where X and Y each independently represents a hydrogen atom or a substituent, A and B each independently represents an alkoxyl group, an alkylthio group, an alkylamino group, an aryloxy group, an arylthio group, an anilino group, a heterocyclic oxy group, a heterocyclic thio group or a heterocyclic amino group, and each of X and Y, and A and B may be combined with each other to form a ring structure.

18. The photothermographic material according to claim 1, wherein a pH of a surface of an outermost layer on an image forming layer is 6 or less.

19. The photothermographic material according to claim 18, wherein a pH of a surface of an outermost layer on an image forming layer is 5.5 or less.

20. The photothermographic material according to claim 19, wherein a pH of a surface of an outermost layer on an image forming layer is 5.3 or less.

21. The photothermographic material according to claim 1, wherein the nucleation agent is a substituted alkene derivative represented by Formula (3), (3)

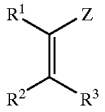

where $R^1$, $R^2$ and $R^3$ each independently represents a hydrogen atom or a substituent, Z represents an electron withdrawing group or a silyl group, and $R^1$ and Z, $R^2$ and $R^3$, $R^1$ and $R^2$, and/or $R^3$ and Z may be combined with each other to form a ring.

22. The photothermographic material according to claim 1, wherein the nucleation agent is a substituted isoxazole derivative represented by Formula (4), (4)

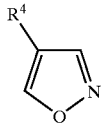

where $R^4$ represents a substituent.

23. The photothermographic material according to claim 1, wherein the nucleation agent is an acetal compound represented by Formula (5), (5)

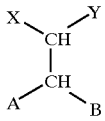

where X and Y each independently represents a hydrogen atom or a substituent, A and B each independently represents an alkoxyl group, an alkylthio group, an alkylamino group, an aryloxy group, an arylthio group, an anilino group, a heterocyclic oxy group, a heterocyclic thio group or a heterocyclic amino group, and each of X and Y, and A and B may be combined with each other to form a ring structure.

* * * * *